US008288069B2

(12) United States Patent
Fujikawa et al.

(10) Patent No.: US 8,288,069 B2
(45) Date of Patent: Oct. 16, 2012

(54) TONER AND TWO-COMPONENT DEVELOPER

(75) Inventors: Hiroyuki Fujikawa, Yokohama (JP); Kunihiko Nakamura, Gotemba (JP); Nozomu Komatsu, Susono (JP); Yoshiaki Shiotari, Mishima (JP); Takeshi Ohtsu, Toride (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/940,164

(22) Filed: Nov. 5, 2010

(65) Prior Publication Data

US 2011/0136060 A1 Jun. 9, 2011

Related U.S. Application Data

(60) Division of application No. 12/472,944, filed on May 27, 2009, now abandoned, and a continuation of application No. PCT/JP2008/073696, filed on Dec. 26, 2008.

(30) Foreign Application Priority Data

Dec. 27, 2007 (JP) ..... 2007-335922

(51) Int. Cl.
*G03G 9/08* (2006.01)

(52) U.S. Cl. ..... 430/137.1; 430/137.18

(58) Field of Classification Search ..... 430/137.1, 430/137.18

See application file for complete search history.

(56) References Cited

U.S. PATENT DOCUMENTS

| | | | | |
|---|---|---|---|---|
| 7,112,395 | B2 | 9/2006 | Ida et al. | 430/109.4 |
| 7,144,668 | B2 | 12/2006 | Baba et al. | 430/109.4 |
| 7,244,539 | B2 | 7/2007 | Baba et al. | |
| 7,267,919 | B2 | 9/2007 | Moribe et al. | 430/108.23 |
| 7,273,686 | B2 | 9/2007 | Onuma et al. | 430/110.3 |
| 7,288,348 | B2 | 10/2007 | Hayami et al. | 430/45.1 |
| 7,288,353 | B2 | 10/2007 | Sugiura et al. | 430/110.3 |
| 7,288,354 | B2 | 10/2007 | Moribe et al. | 430/110.3 |

(Continued)

FOREIGN PATENT DOCUMENTS

CN 1609720 A 4/2005

(Continued)

OTHER PUBLICATIONS

Chinese Office Action dated Nov. 1, 2011 in Chinese Application No. 200880122942.X.

*Primary Examiner* — Hoa V Le

(74) *Attorney, Agent, or Firm* — Fitzpatrick, Cella, Harper & Scinto

(57) ABSTRACT

Provided is a toner including: toner particles each containing at least a binder resin and a wax; and an external additive, in which surfaces of the toner particles have an average surface roughness (Ra) measured with a scanning probe microscope of 1.0 nm or more and 30.0 nm or less; and the toner has a surface tension index I for a 45-vol % aqueous solution of methanol measured by a capillary suction time method and calculated from the following equation (1) of $5.0\times10^{-3}$ N/m or more and $1.0\times10^{-1}$ N/m or less:

$$I=P_{\alpha}/(A\times B\times 10^{6}) \quad \text{Eq. (1)}$$

where I represents the surface tension index (N/m) of the toner, $P_{\alpha}$ represents a capillary pressure ($N/m^2$) of the toner for the 45-vol % aqueous solution of methanol, A represents a specific surface area ($m^2/g$) of the toner, and B represents a true density ($g/cm^3$) of the toner.

3 Claims, 3 Drawing Sheets

U.S. PATENT DOCUMENTS

| | | | | |
|---|---|---|---|---|
| 7,297,455 | B2 | 11/2007 | Fujikawa et al. | 430/45.1 |
| 7,300,733 | B2 | 11/2007 | Sugahara et al. | 430/108.4 |
| 7,358,023 | B2 | 4/2008 | Yamazaki et al. | 430/137.18 |
| 7,361,441 | B2 | 4/2008 | Itakura et al. | 430/107.1 |
| 7,452,647 | B2 | 11/2008 | Hayami et al. | 430/109.4 |
| 7,452,649 | B2 | 11/2008 | Magome et al. | 430/111.3 |
| 7,517,627 | B2 | 4/2009 | Kashiwabara et al. | 430/109.3 |
| 2001/0000743 | A1* | 5/2001 | Yuasa et al. | 430/110 |
| 2002/0009661 | A1 | 1/2002 | Hashimoto et al. | 430/106.1 |
| 2002/0072006 | A1 | 6/2002 | Mizoo et al. | 430/108.22 |
| 2002/0098433 | A1 | 7/2002 | Matsunaga et al. | 430/108.8 |
| 2004/0091803 | A1* | 5/2004 | Yamazaki et al. | 430/108.1 |
| 2005/0026065 | A1* | 2/2005 | Onuma et al. | 430/110.3 |
| 2005/0048390 | A1* | 3/2005 | Moribe et al. | 430/109.3 |
| 2007/0122727 | A1* | 5/2007 | Ida et al. | 430/108.3 |
| 2008/0070145 | A1* | 3/2008 | Onda et al. | 430/110.4 |
| 2008/0279591 | A1* | 11/2008 | Yasunaga et al. | 399/252 |
| 2009/0029280 | A1 | 1/2009 | Yamamoto et al. | 430/110.3 |
| 2009/0087767 | A1 | 4/2009 | Nakamura | 430/108.2 |
| 2009/0104554 | A1 | 4/2009 | Otsuka et al. | 430/108.3 |
| 2009/0246675 | A1 | 10/2009 | Nakamura et al. | 430/111.31 |

FOREIGN PATENT DOCUMENTS

| | | | |
|---|---|---|---|
| JP | 02-087157 | | 3/1990 |
| JP | 07-181732 | | 7/1995 |
| JP | 09-281805 | | 10/1997 |
| JP | 11-295929 | | 10/1999 |
| JP | 2002-091090 | | 3/2002 |
| JP | 2003-162090 | | 6/2003 |
| JP | 2004-138691 | | 5/2004 |
| JP | 2004-271853 | | 9/2004 |
| JP | 2005-315907 | A | 11/2005 |
| JP | 2006-309048 | | 11/2006 |
| JP | 2007-148077 | | 6/2007 |
| KR | 10-2004-0098531 | A | 11/2004 |

* cited by examiner

TONER AND TWO-COMPONENT DEVELOPER

This is a divisional of application Ser. No. 12/472,944 filed May 27, 2009 now abandoned which, in turn, is a continuation of PCT/JP08/073696, filed Dec. 26, 2008, and which claims benefit of those applications under 35 U.S.C. §120 and claims benefit under 35 U.S.C. §119 of Japanese Patent Application No. 2007-335922, filed Dec. 27, 2007. The entire content of each of the mentioned prior applications are incorporated herein by reference.

BACKGROUND OF THE INVENTION

1. Field of the Invention

The present invention relates to a toner and a two-component developer each of which is used in an electrophotographic system, electrostatic recording system, electrostatic printing system, or toner jet system.

2. Description of the Related Art

Developing systems such as electrophotography are classified into a one-component developing system involving the use of toner alone and a two-component developing system involving the use of a mixture of a magnetic carrier and toner.

The two-component developing system provides a stable charging characteristic and is advantageous for maintaining high image quality over a long time period as compared to the one-component developing system because of the following reason: the two-component developing system involves the use of the magnetic carrier, and hence the triboelectric charging area of the magnetic carrier with respect to the toner can be widened. In addition, the two-component developing system is often used particularly in a high-speed machine because the magnetic carrier shows a high ability to feed the toner to a developing zone.

The surface characteristics of a toner particle have been known to affect various physical properties of toner such as charging performance. In view of the foregoing, the following contrivance has been conventionally made: the performance of the toner is improved by treating the surface of each particle of the toner. For example, a method involving mechanically smoothing the surface has been known (JP 02-87157 A and JP 07-181732 A).

However, an improvement in smoothness achieved by the mechanical surface treatment is still limited. A treatment with hot air has been known as another method to replace the treatment (JP 11-295929 A, JP 2003-162090 A, JP 2003-270856 A, and JP 2004-138691 A).

Although the treatment with hot air provides extremely high surface smoothness and improves the performance of the toner, the treatment is still susceptible to improvement in terms of a reduction in toner consumption and the prevention of toner scattering.

In addition, a spheroidized toner having a surface with its unevenness controlled has been known (JP 2004-246344 A).

Although such toner has achieved compatibility among charging performance, developing performance, and transferring performance, the toner still shows insufficient performance in terms of the prevention of scattering and dot reproducibility when applied to a high-speed machine.

A resin-coated magnetic carrier having an average particle diameter of 25 μm or more and 55 μm or less and a specified intensity of magnetization (JP 2002-91090 A) and a magnetic carrier having a volume magnetization of 20 emu/cm$^3$ or more and 60 emu/cm$^3$ or less (JP 09-281805 A) have been proposed as magnetic carriers used in two-component developers.

In each of those proposals, it is disclosed that the naps of a magnetic carrier on a developer carrying member are made dense so that dot reproducibility of electrostatic latent image on the image bearing member is improved, and excellent developing performance during a durability test under a normal-temperature, normal-humidity (having a temperature of 25° C. and a humidity of 50% RH) environment is achieved. However, each of the magnetic carriers is still susceptible to improvement in terms of the prevention of scattering, and developing performance and dot reproducibility at the time of a durability test under a high-temperature, high-humidity environment (having a temperature of 32.5° C. and a humidity of 80% RH).

As described above, various proposals have been made, but each of them is still susceptible to improvement in terms of a reduction in toner consumption, the prevention of scattering, and developing performance and dot reproducibility at the time of a durability test under a high-temperature, high-humidity environment (having a temperature of 32.5° C. and a humidity of 80% RH). Accordingly, a toner and a two-component developer each of which is capable of solving those problems have been demanded.

SUMMARY OF THE INVENTION

An object of the present invention is to provide a toner and a two-component developer each of which has solved problems as described above. That is, the object is to provide a toner and a two-component developer each having the following characteristics: each of the toner and the two-component developer is excellent in transferring performance, can achieve a reduction in toner consumption, and is excellent in scattering characteristic, and developing performance and dot reproducibility at the time of a durability test under a high-temperature, high-humidity environment (having a temperature of 32.5° C. and a humidity of 80% RH).

The inventors of the present invention have considered that the above object can be achieved by causing the surface roughness (Ra) of each surface of the toner particles and the surface tension index of the toner to satisfy predetermined ranges. Thus, the inventors have reached the present invention. That is, the present invention is as described below.

The present invention relates to a toner including: toner particles each containing at least a binder resin and a wax; and an external additive, in which surfaces of the toner particles have an average surface roughness (Ra) measured with a scanning probe microscope of 1.0 nm or more and 30.0 nm or less; and the toner has a surface tension index I for a 45-vol % aqueous solution of methanol measured by a capillary suction time method and calculated from the following equation (1) of $5.0\times10^{-3}$ N/m or more and $1.0\times10^{-1}$ N/m or less:

$$I=P_{\alpha}/(A\times B\times10^{6}) \quad \text{Eq. (1)}$$

where I represents the surface tension index (N/m) of the toner, $P_{\alpha}$ represents a capillary pressure (N/m$^2$) of the toner for the 45-vol % aqueous solution of methanol, A represents a specific surface area (m$^2$/g) of the toner, and B represents a true density (g/cm$^3$) of the toner.

In addition, the present invention relates to a two-component developer including a magnetic carrier and the toner.

According to a preferred embodiment of the present invention, there can be provided a toner and a two-component developer each having the following characteristics: each of the toner and the two-component developer is excellent in transferring performance, can achieve a reduction in toner consumption, and is excellent in scattering characteristic, and developing performance and dot reproducibility at the time of a durability test under a high-temperature, high-humidity environment (having a temperature of 32.5° C. and a humidity of 80% RH).

DESCRIPTION OF SYMBOLS

Figure 1:
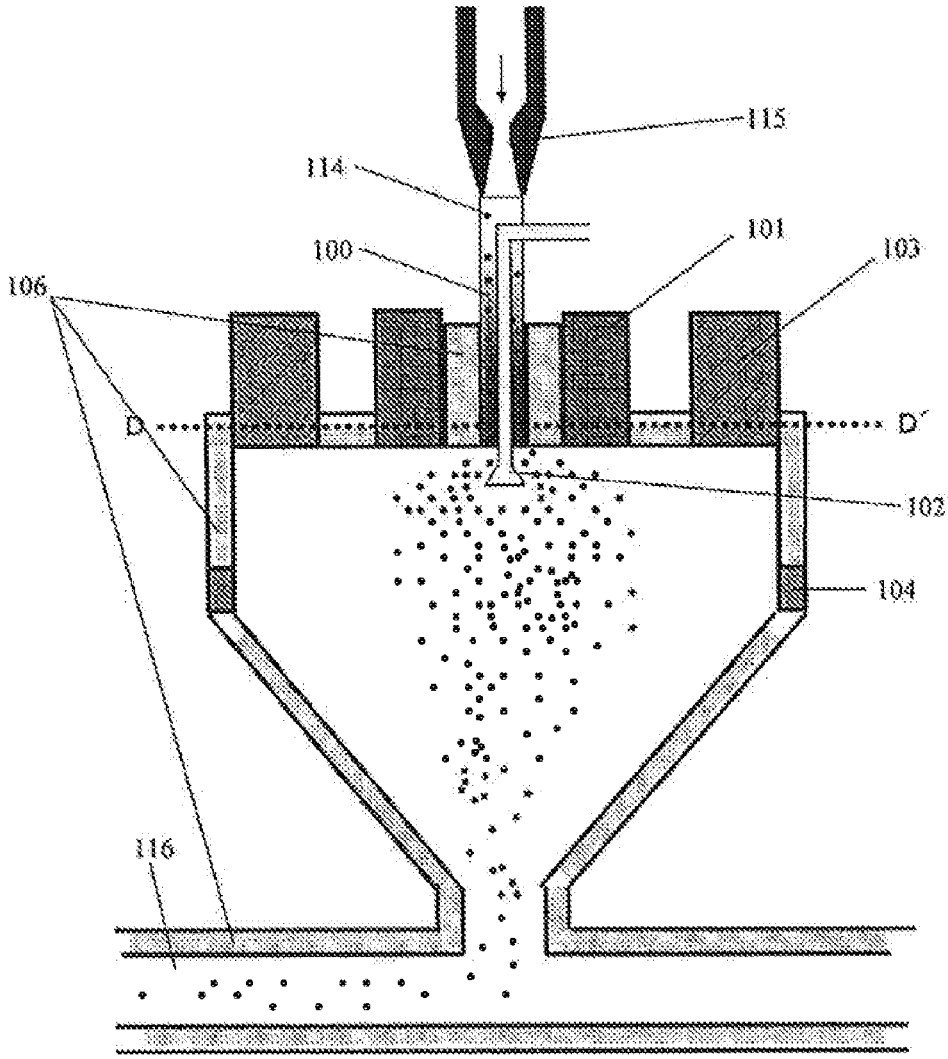
FIG. 1 shows an outline sectional view of a surface treatment apparatus of the present invention.

100: toner-feeding port
101: hot air-feeding port
102: airflow-injecting member
103: cold air-feeding port
104: second cold air-feeding port
106: cooling jacket
110: diffusion air
111: airflow-feeding port intended for prevention of condensation
112: diffusion member having a plurality of holes
114: toner
115: high-pressure air-feeding nozzle
116: transfer pipe

DESCRIPTION OF THE EMBODIMENTS

A toner of the present invention includes: toner particles each containing at least a binder resin and a wax; and an external additive, in which surfaces of the toner particles have an average surface roughness (Ra) measured with a scanning probe microscope of 1.0 nm or more and 30.0 nm or less; and the toner has a surface tension index I for a 45-vol % aqueous solution of methanol measured by a capillary suction time method and calculated from the following equation (1) of $5.0\times10^{-3}$N/m or more and $1.0\times10^{-1}$ N/m or less:

$$I=P_\alpha/(A\times B\times10^6) \quad \text{Eq. (1)}$$

where I represents the surface tension index (N/m) of the toner, $P_\alpha$ represents a capillary pressure (N/m$^2$) of the toner for the 45-vol % aqueous solution of methanol, A represents a specific surface area (m$^2$/g) of the toner, and B represents a true density (g/cm$^3$) of the toner.

In the toner of the present invention, the surfaces of the toner particles have an average surface roughness (Ra) measured with a scanning probe microscope of 1.0 nm or more and 30.0 nm or less. In addition, the surfaces of the toner particles have an average surface roughness (Ra) of preferably 2.0 nm or more and 25.0 nm or less and more preferably 3.0 nm or more and 20.0 nm or less.

When the average surface roughness (Ra) of the surfaces of the toner particles falls within the above range, the toner is excellent in transferring performance, can achieve a reduction in toner consumption, and is excellent in developing performance and dot reproducibility at the time of a durability test under a high-temperature, high-humidity environment (having a temperature of 32.5° C. and a humidity of 80% RH). A state where the average surface roughness (Ra) of the surfaces of the toner particles falls within the above range means that the toner particles each have a smooth surface. When the surface of each toner particle is smooth, the external additive can be uniformly present on the surface of each toner particle, and hence the toner shows a sharp charge distribution. As a result, the above effect may arise.

When the charge distribution is sharp, for example, a reduction in toner consumption can be achieved because the movement of each toner in each of a developing step and a transferring step is facilitated.

In addition, when the average surface roughness (Ra) of the surfaces of the toner particles falls within the above range, the rise-up of the charging of the toner becomes extremely quick, and hence the toner can maintain good developing performance from the initial stage of a durability test under a high-temperature, high-humidity environment.

When the average surface roughness (Ra) of the surfaces of the toner particles is less than 1.0 nm, the charging performance of the toner becomes so high that a reduction in density due to charge up is apt to occur.

On the other hand, when the average surface roughness (Ra) of the surfaces of the toner particles is larger than 30.0 nm, the distribution of the external additive on the surface of each toner particle varies, and hence the charge distribution of the toner varies, and the consumption of the toner increases. In addition, under a high-temperature, high-humidity environment, the rise-up of the charging of the toner becomes slow, and hence a variation in charge distribution becomes additionally large, a reduction in image density and fogging become remarkable, and the dot reproducibility deteriorates.

The above average surface roughness (Ra) of the surfaces of the toner particles can be adjusted to fall within the above range by treating the surfaces with heat or a mechanical impact force at the time of the production of the toner.

In the toner of the present invention, the surfaces of the toner particles have a ten point height of roughness (Rz) measured with a scanning probe microscope of preferably 10 nm or more and 1,000 nm or less, more preferably 20 nm or more and 900 nm or less, or particularly preferably 30 nm or more and 800 nm or less.

The above ten point height of roughness (Rz) of the surfaces of the toner particles preferably falls within the above range because of the following reason: the amount of the external additive entering the depressed portions of the toner is reduced, and hence the amount of an effective external additive on the surface of each toner particle increases, and the charge distribution becomes sharp.

The above ten point height of roughness (Rz) of the surfaces of the toner particles can be adjusted to fall within the above range by treating the surfaces mechanically or thermally at the time of the production of the toner.

In the present invention, the above average surface roughness (Ra) and ten point height of roughness (Rz) of the surfaces of the toner particles are measured with a scanning probe microscope. Details about the measurement will be described later.

In addition, the toner of the present invention has a surface tension index for a 45-vol % aqueous solution of methanol measured by a capillary suction time method and calculated from the following equation (1) of $5.0\times10^{-3}$ N/m or more and $1.0\times10^{-1}$ N/m or less:

$$I=P_\alpha/(A\times B\times10^6) \quad \text{Eq. (1)}$$

where I represents the surface tension index (N/m) of the toner, $P_\alpha$ represents a capillary pressure (N/m$^2$) of the toner for the 45-vol % aqueous solution of methanol, A represents a specific surface area (m$^2$/g) of the toner, and B represents a true density (g/cm$^3$) of the toner. The surface tension index I of the toner is preferably $5.0\times10^{-3}$ N/m or more and $7.5\times10^{-2}$ N/m or less and more preferably $5.0\times10^{-3}$ N/m or more and $5.0\times10^{-2}$ N/m or less.

The above surface tension index of the toner indicates the extent to which the surface of the toner is made hydrophobic, and it is an index which is largely depended on an influence of the hydrophobicity of the surface of each toner particle plus an influence of the external additive. The larger the surface tension index, the larger the extent to which the toner surface is made hydrophobic. It should be noted that the surface tension index specified in the present invention is an index calculated from a pressure applied to infiltrate methanol into the fine structure of the toner surface. Accordingly, the use of the surface tension index allows one to evaluate the toner for hydrophobicity in consideration of an influence of a finer structure than that in the case of conventional evaluation for hydrophobicity, in particular, fine unevenness on the surface of each toner particle.

When the above surface tension index of the toner is $5.0\times10^{-3}$ N/m or more and $1.0\times10^{-1}$ N/m or less, the adhesive force of the external additive to each toner particle is moderate, and hence the liberation of the external additive from the surface of each toner particle can be suppressed. As a result, the developing performance of the toner at the time of a durability test under a high-temperature, high-humidity environment (having a temperature of 32.5° C. and a humidity of 80% RH) is improved even in a case where the toner receives a high stress such as a developing device of a high-speed machine. In addition, the scattering of the toner can be alleviated even when a transferring step is performed at a high contact pressure.

In the toner of the present invention, the above average surface roughness (Ra) of the surfaces of the toner particles satisfies the above range, and hence the external additive is distributed in a uniform state. In addition, the above surface tension index of the toner satisfies the above range, and hence the ratio at which the surface of the toner is made hydrophobic is high and falls within a moderate range. Accordingly, the above effect may be obtained.

In addition, a fine powder subjected to a hydrophobic treatment with, for example, a coupling agent is particularly preferably used as the external additive because the enlargement of the extent to which the liberation of the external additive is suppressed is effective in additionally improving the above effect.

In other words, when the external additive is present on the toner surface uniformly and stably, the amount of toner which has been made hydrophobic at a low ratio reduces, and hence an adhesive force between toner becomes uniform. As a result, the scattering of the toner may tend to be alleviated even when a transferring step is performed at a high contact pressure.

When the above surface tension index of the toner exceeds $1.0\times10^{-1}$ N/m, the ratio at which the toner surface is made hydrophobic becomes excessively high, and hence the charge distribution of the toner becomes broad. As a result, a reduction in image density or fogging occurs under a high-temperature, high-humidity environment. Further, when the surface tension index increases owing to the elution of a large amount of the wax to the toner surface, there is a possibility that transfer efficiency reduces, or a reduction in charging performance of the toner occurs owing to the adhesion of the wax to a certain member. In addition, the melt adhesion of the toner to a certain member may occur.

On the other hand, when the above surface tension index of the toner is less than $5.0\times10^{-3}$N/m, the adhesive force of the external additive to each toner particle is low, and hence the external additive is apt to desorb from the toner surface. Accordingly, the scattering of the toner becomes remarkable, or the charging performance of the toner reduces when a transferring step is performed at a high contact pressure. As a result, a reduction in image density and fogging become remarkable under a high-temperature, high-humidity environment.

In the present invention, the surface tension index of the toner can be adjusted to fall within the above range by subjecting the surface of the toner to a hydrophobic treatment.

A method for the above hydrophobic treatment is, for example, a method involving treating the toner surface with a known hydrophobic substance (treatment agent). A coupling agent, a fine particle, wax, oil, varnish, or organic compound treated with a coupling agent, or the like can be used as the treatment agent.

A specific method is as follows: the surface of each toner particle is made hydrophobic with a wax upon performance of a surface treatment for the toner with hot air. It should be noted that the present invention is not limited to the foregoing method.

When the surface of the toner is treated with hot air, if an excessive quantity of heat is applied to the surface of the toner, a large amount of the wax migrates to the surface of each toner particle, or the state of distribution of the wax becomes nonuniform in some cases. Accordingly, the surface tension index of the toner is desirably adjusted to fall within the above range by controlling conditions for the production of the toner such as the temperature of the hot air and the temperature of cooling air to control the amount in which the wax is eluted and the distribution of the wax.

The wax dispersed in the above toner particles preferably has an average primary dispersed particle diameter of 0.01 μm or more and 1.00 μm or less in order that the amount in which the wax is eluted to the surface of each toner particle and the distribution of the wax to the surface may be controlled. The average primary dispersed particle diameter is more preferably 0.05 μm or more and 0.80 μm or less, or particularly preferably 0.10 μm or more and 0.60 μm or less.

When the average primary dispersed particle diameter of the wax falls within the above range, the ease with which the migration rate of the wax to the surface of each toner particle is controlled in the case where the surface treatment is performed with hot air can be improved, and hence nonuniform, excessive elution of the wax can be suppressed. In addition, the wax is uniformly dispersed in each toner particle, and hence the wax is uniformly eluted to the toner surface, and the charge quantity of the toner is stabilized.

The above average primary dispersed particle diameter of the wax dispersed in the toner particles can be adjusted to fall within the above range by controlling the kinds and combination of binder resins to be used, the kind and addition amount of the wax to be used, and, furthermore, conditions for a kneading step and a cooling step at the time of the production of the toner. To be specific, a polymer having a structure obtained by a reaction between a vinyl-based resin component and a hydrocarbon compound is preferably further incorporated into each toner particle together with the wax.

A graft polymer having a structure in which a polyolefin is grafted to the vinyl-based resin component, or a graft polymer having a vinyl-based resin component in which a vinyl-based monomer is subjected to graft polymerization with a polyolefin is particularly preferably used as the above polymer having a structure obtained by a reaction between the vinyl-based resin component and the hydrocarbon compound.

The above polymer having a structure obtained by a reaction between the vinyl-based resin component and the hydrocarbon compound serves as a surfactant for the binder resin and the wax which have been melted in the kneading step or a surface smoothing step at the time of the production of the toner. Therefore, the polymer is preferable because the polymer can control: the average primary dispersed particle diameter of the wax in the toner particles; and the migration rate of the wax to the toner surface upon performance of the surface treatment with hot air.

The graft polymer having a structure in which the polyolefin is grafted to the vinyl-based resin component, or graft polymer having a vinyl-based resin component in which the vinyl-based monomer is subjected to graft polymerization with the polyolefin described above is not particularly limited as long as the polyolefin is a polymer or copolymer of an unsaturated hydrocarbon-based monomer having one double bond, and any one of the various polyolefins can be used; a polyethylene-based polyolefin or a polypropylene-based polyolefin is particularly preferably used.

On the other hand, as vinyl-based monomers, the following are exemplified.

Styrene-based monomers such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, and derivatives thereof.

Nitrogen atom-containing vinyl-based monomers including amino group-containing α-methylene aliphatic monocarboxylates such as dimethyl aminoethyl methacrylate, diethyl aminoethyl methacrylate; and acrylic acids or methacrylic acid derivatives such as acrylonitrile, methacrylonitrile, and acrylamide.

The examples further include: carboxyl group-containing vinyl-based monomer including unsaturated dibasic acids such as maleic acid, citraconic acid, itaconic acid, an alkenylsuccinic acid, fumaric acid, and mesaconic acid; unsaturated dibasic acid anhydrides such as maleic anhydride, citraconic anhydride, itaconic anhydride, and an alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride, and anhydrides of the α,β-unsaturated acids and lower fatty acids; an alkenylmalonic acid, an alkenylglutaric acid, and an alkenyladipic acid, and anhydrides and monoesters of these acids.

The examples further include: hydroxyl group-containing vinyl-based monomer including acrylates or methacrylates such as 2-hydroxyethyl acrylate, 2-hydroxyethyl methacrylate, and 2-hydroxypropyl methacrylate; and 4-(1-hydroxy-1-methylbutyl)styrene and 4-(1-hydroxy-1-methylhexyl)styrene.

An ester unit formed of an acrylate including acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate.

An ester unit formed of a methacrylate including α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl aminoethyl methacrylate, and diethyl aminoethyl methacrylate.

The polymer having a structure obtained by a reaction between the vinyl-based resin component and the hydrocarbon compound can be obtained by a known method such as a reaction between the above-mentioned monomers for these or a reaction between a monomer for one polymer and the other polymer.

The vinyl-based resin component preferably contains, as constitutional units, a styrene-based unit, and, furthermore, acrylonitrile or methacrylonitrile.

A mass ratio between the hydrocarbon compound and the vinyl-based resin component in the above polymer is preferably 1/99 to 75/25. The hydrocarbon compound and the vinyl-based resin component are preferably used at a ratio in the above range in order that the wax may be favorably dispersed in each toner particle.

The content of the above polymer having a structure obtained by a reaction between the vinyl-based resin component and the hydrocarbon compound is preferably 0.2 part by mass or more and 20 parts by mass or less with respect to 100 parts by mass of the binder resin. The above polymer is preferably used at a content in the above range in order that the wax may be favorably dispersed in each toner particle.

In the toner of the present invention, the abundance of the wax on the surface of the above toner is preferably 60% or more and 100% or less, more preferably 70% or more and 98% or less, or still more preferably 80% or more and 95% or less.

The above abundance of the wax on the toner surface can be determined by calculation from a composition ratio between toner materials and an element concentration on the toner surface measured by X-ray photoelectron spectrometer (ESCA).

For example, suppose that element concentrations determined from the resin composition of the binder resin used in the toner are "carbon [C] 80 atom %, oxygen [O] 20 atom %", element concentrations determined from the composition of the wax used in the toner (such as a hydrocarbon wax) are "carbon [C] 100 atom %, oxygen [O] 0 atom %", and element concentrations measured by X-ray photoelectron spectrometer (ESCA) are "carbon [C] 97 atom %, oxygen [O] 3 atom %". In this case, the abundance of the wax on the surface of the toner is calculated to be 85% from the following calculation.

$$\{(20-3)/20\}\times 100=85(\%) \quad \text{(Equation)}$$

For example, suppose that element concentrations determined from the resin composition of the binder resin used in the toner are "carbon [C] 80 atom %, oxygen [O] 20 atom %", element concentrations determined from the composition of the wax used in the toner (such as a ester wax) are "carbon [C] 95 atom %, oxygen [O] 5 atom %", and element concentrations measured by X-ray photoelectron spectrometer (ESCA) are "carbon [C] 93 atom %, oxygen [O] 7 atom %". In this case, the abundance of the wax on the surface of the toner is calculated to be 87% from the following calculation.

$$\{(20-7)/(20-5)\}\times 100=87(\%) \quad \text{(Equation)}$$

The above abundance of the wax on the toner surface is preferably 60% or more and 100% or less because the degree to which the material is uniformly distributed on the toner surface is high, and hence the charging performance of the toner becomes uniform. The above abundance of the wax on the toner surface can be adjusted to fall within the above range by controlling treatment conditions at the time of the surface treatment, the kind and amount of the wax to be used, and the average primary dispersed particle diameter of the wax dispersed in the toner particles.

The toner of the present invention preferably has an average circularity of 0.950 or more and 1.000 or less regarding the circularity distribution measured with a flow-type particle image measuring apparatus having an image processing resolution of 512×512 pixels (0.37 μm by 0.37 μm per pixel) for particles having a circle-equivalent diameter of 2.00 μm or more and 200.00 or less. The average circularity is more preferably 0.955 or more and 0.990 or less, or particularly preferably 0.960 or more and 0.985 or less. Setting the average circularity of the toner within the above range means that the number of the protruded and depressed portions of the toner reduces. In particular, the amount of the external additive entering the depressed portions reduces by virtue of a reduction in number of depressed portions of the toner, whereby the amount of the external additive desorbing from the toner surface reduces. As a result, the charge distribution of the toner becomes sharp, and hence the consumption of the toner can be additionally reduced, and the desorption of the external additive can be suppressed. Accordingly, a toner additionally excellent in developing performance in a durability test under a high-temperature, high-humidity environment can be obtained.

The above average circularity of the toner can be adjusted to fall within the above range by treating the surface of each toner particle.

The surface of each toner particle, which can be treated with, for example, heat or a mechanical impact force, is more preferably treated with hot air. In any such surface treatment method, the surface of each toner particle is coated with the wax internally added to the particle while the edges of the toner particle are removed with heat or a mechanical impact force. In addition, the following method is preferable: in a state where the toner particles are diffused in the air, the toner particles are caused to exist instantaneously in high-temperature hot air, and, immediately after that, the particles are instantaneously cooled with cold air. The above cold air is preferably dehumidified cold air, specifically, cold air having an absolute moisture content of 5 $g/m^3$ or less.

The above approach allows one to treat the surfaces of the toner particles uniformly without applying excessive heat to the toner particles. In addition, the approach allows one to treat only the surface of each toner particle while preventing the alteration of a raw material component. As a result, the migration of an excessive amount of the wax to the surface of each toner particle and nonuniform migration of the wax can be prevented. Details about the above surface treatment with hot air will be described later.

The toner of the present invention has a weight-average particle diameter (D4) of preferably 3.0 μm or more and 8.0 μm or less, more preferably 4.0 μm or more and 7.0 μm or less, or particularly preferably 4.5 μm or more and 6.5 μm or less. Setting the weight-average particle diameter (D4) of the toner within the above range is a preferable measure from the viewpoint of additional improvements in dot reproducibility and transfer efficiency. The weight-average particle diameter (D4) of the toner can be adjusted by classifying the toner particles at a certain stage in the production of the toner.

As the binder resin used for the toner of the present invention, a known resin can be used. Examples thereof include: polystyrene; homopolymers of styrene derivatives such as polyvinyltoluene; styrene-based copolymers such as a styrene-propylene copolymer, a styrene-vinyltoluene copolymer, a styrene-vinylnaphthaline copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-octyl methacrylate copolymer, a styrene-dimethylaminoethyl methacrylate copolymer, a styrene-vinylmethyl ether copolymer, a styrene-vinylethyl ether copolymer, a styrene-vinylmethyl ketone copolymer, a styrene-butadiene copolymer, a styrene-isoprene copolymer, a styrene-maleic acid copolymer, and a styrene-maleate copolymer; polymethyl methacrylate; polybutyl methacrylate; polyvinyl acetate; polyethylene; polypropylene; polyvinyl butyral; a silicone resin; a polyester resin; a hybrid resin in which a styrene-based polymer unit and a polyester unit are chemically bonded; a polyamide resin, an epoxy resin, a polyacrylic resin, rhodine; modified rhodine; a terpene resin; a phenol resin; an aliphatic or alicyclic hydrocarbon resin; and an aromatic petroleum resin. Those may be used alone or in mixture.

Of those, a resin containing a styrene-based copolymer and/or a polyester unit are/is preferably used as the binder resin.

As examples of a polymerizable monomer to be used in styrene-based copolymers, the following are exemplified: styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; monoolefins such as ethylene, propylene, butylene, and isobutylene; polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butylacrylate, isobutylacrylate, n-octyl acrylate, dodecyl acrylate, 2-ethylhexyl acrylate, stearyl acrylate, 2-chloroethylacrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

The examples further include: unsaturated dibasic acids such as maleic acid, citraconic acid, itaconic acid, an alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride, and anhydrides of the α,β-unsaturated acids and lower fatty acids; and monomers each having a carboxyl group such as an alkenylmalonic acid, an alkenylglutaric acid, and an alkenyladipic acid, and anhydrides and monoesters of these acids.

The examples further include: acrylates or methacrylates such as 2-hydroxyethyl acrylate, 2-hydroxyethyl methacrylate, and 2-hydroxypropyl methacrylate; and monomers each having a hydroxy group such as 4-(1-hydroxy-1-methylbutyl)styrene and 4-(1-hydroxy-1-methylhexyl)styrene.

The above binder resin preferably contains a resin having at least a polyester unit; the resin having a polyester unit in all the binder resins accounts for more preferably 50 mass % or more, or particularly preferably 70 mass % or more of all the binder resins. The resin having a polyester unit in all the binder resins preferably accounts for 50 mass % or more of all the binder resins in order that a toner having a surface tension index in the above specific range may be obtained.

The above term "polyester unit" means a portion derived from polyester, and examples of the resin having a polyester unit include a polyester resin and a hybrid resin. Components of which the polyester unit is constituted are specifically an alcohol monomer component which is dihydric or more and an acid monomer component such as a carboxylic acid which is divalent or more, a carboxylic acid anhydride which is divalent or more, or a carboxylic acid ester which is divalent or more.

As examples of the alcohol monomer component which is dihydric or more, the following can be exemplified.

Examples of the dihydric alcohol monomer component include: alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butanediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A.

Examples of the alcohol monomer component which is trihydric or more include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of a divalent carboxylic acid monomer component include aromatic dicarboxylic acids such as phthalic acid, isophthalic acid, and terephthalic acid and anhydrides thereof; alkyl dicarboxylic acids such as succinic acid, adipic acid, sebacic acid, and azelaic acid or anhydrides thereof; succinic acid substituted with an alkyl group having 6 to 18 carbon atoms or an alkenyl group or anhydrides thereof; and unsaturated dicarboxylic acids such as phthalic acid, maleic acid, and citraconic acid, or anhydrides thereof.

Examples of the monomer component of the carboxylic acid which is trivalent or more include polyvalent carboxylic acids such as trimellitic acid, pyromellitic acid, benzophenone tetracarboxylic acid, and anhydrides thereof.

In addition, examples of the another monomer include polyhydric alcohols such as oxyalkylene ether of a novolac-type phenol resin.

Further, as the wax to be used in the toner of the present invention, the following are exemplified.

Aliphatic hydrocarbon waxes such as low-molecular weight polyethylene, low-molecular weight polypropylene, an alkylene copolymer, a microcrystalline wax, a paraffin wax, and a Fischer-Tropsch wax; an aliphatic hydrocarbon wax oxide such as a polyethylene oxide wax or block copolymers of the aliphatic hydrocarbon wax oxide; a wax containing an aliphatic ester as a main component such as a carnauba wax, a behenic acid behenyl wax, and a montanate wax; and a wax containing an aliphatic ester deoxidated partially or totally such as a deoxidated carnauba wax.

Further, linear saturated aliphatic acids such as palmitic acid, stearic acid, and montan acid; unsaturated aliphatic acids such as brassidic acid, eleostearic acid, and barinarin acid; saturated alcohols such as stearyl alcohol, aralkyl alcohol, behenyl alcohol, carnaubyl alcohol, ceryl alcohol, and melissyl alcohol; polyhydric alcohols such as sorbitol; esters of aliphatic acids such as palmitic acid, stearic acid, behenic acid, and montan acid and alcohols such as stearyl alcohol, aralkyl alcohol, behenyl alcohol, carnaubyl alcohol, ceryl alcohol, and melissyl alcohol; aliphatic amides such as linoleic amide, oleic amide, and lauric amide; saturated aliphatic bis amides such as methylene bis stearamide, ethylene bis capramide, ethylene bis lauramide, and hexamethylene bis stearamide; unsaturated aliphatic amides such as ethylene bis oleamide, hexamethylene bis oleamide, N,N'-dioleyl adipamide, and N,N'-dioleyl sebacamide; aromatic bis amides such as m-xylene bis stearamide and N—N'-distearyl isophthalamide; aliphatic acid metallic salts (generally called metallic soaps) such as calcium stearate, calcium laurate, zinc stearate, and magnesium stearate; graft waxes in which aliphatic hydrocarbon waxes are grafted with vinyl-based monomers such as styrene and acrylic acid; partially esterified compounds of aliphatic acids and polyalcohol such as behenic monoglyceride; and methyl ester compounds having hydroxyl groups obtained by hydrogenation of vegetable oil.

Examples of a wax that can be particularly preferably used include an aliphatic hydrocarbon wax and an esterified compound as an ester of an aliphatic acid and an alcohol. Examples of the foregoing include: a low-molecular-weight alkylene polymer obtained by subjecting an alkylene to radical polymerization under high pressure or by polymerizing an alkylene under reduced pressure by using a Ziegler catalyst or a metallocene catalyst; an alkylene polymer obtained by the thermal decomposition of a high-molecular-weight alkylene polymer; and a synthetic hydrocarbon wax obtained from a residue on distillation of a hydrocarbon obtained by an Age method from a synthetic gas containing carbon monoxide and hydrogen, and a synthetic hydrocarbon wax obtained by the hydrogenation of the residue on distillation of hydrocarbon. Further, paraffin wax is also preferably used.

In addition, the wax used in the toner of the present invention, in the endothermic curve upon heating which is measured by a differential scanning calorimetry (DSC) apparatus, has a peak temperature at the maximum endothermic peak present in the temperature of range of 30° C. or higher and 200° C. or lower is preferably in the range of 45° C. or higher and 140° C. or lower, more preferably in the range of 65° C. or higher and 120° C. or lower, and particularly preferably 65° C. or higher and 100° C. or lower.

When the wax has the peak temperature at the maximum endothermic is preferably in the range of 45° C. or higher and 140° C. or lower in order to achieve favorable fixability.

The content of the wax is preferably 3 parts by mass or more and 20 parts by mass or less, more preferably 3 parts by mass or more and 15 parts by mass or less, and still more preferably 3 parts by mass or more and 10 parts by mass or less with respect to 100 parts by mass of the binder resin.

The main peak molecular weight of the toner of the present invention, in a molecular weight distribution measured by gel permeation chromatography (GPC) of tetrahydrofuran (THF) soluble content of the toner, has preferably a molecular weight of 2,000 or more and 15,000 or less and more preferably 2,500 or more and 13,000 or less. In addition the weight average molecular weight (Mw)/number average molecular weight (Mn) is preferably 3.0 or more and more preferably 5.0 or more. In addition, Mw/Mn is preferably 1,000 or less.

The main peak molecular weight and the Mw/Mn described above preferably satisfy the above ranges because of the following reasons: good compatibility between the low-temperature fixability and hot offset resistance of the toner can be achieved, and, when the surface treatment is performed with hot air, the treatment can be performed efficiently and the coalescence of the toner particles can be favorably prevented.

The toner of the present invention preferably has a glass transition temperature (Tg) of 40° C. or higher and 90° C. or lower and a softening temperature (Tm) of 80° C. or higher and 150° C. or lower because of the following reasons: compatibility among storage stability, low-temperature fixability, and hot offset resistance can be achieved, and, when the surface treatment is performed with hot air, the coalescence of the toner can be favorably prevented.

The toner particles according to the present invention can be turned into magnetic toner particles by incorporating a magnetic substance into each of the particles. When the magnetic substance is incorporated so that the toner may be used as a magnetic toner, the magnetic substance can serve also as a colorant.

Examples of the magnetic substance include: iron oxides such as magnetite, maghemite, and ferrite; and magnetic metals such as iron, cobalt, and nickel, and metal alloys of those magnetic metals and a metal such as aluminum, cobalt, copper, lead, magnesium, tin, zinc, antimony, beryllium, bismuth, cadmium, calcium, manganese, selenium, titanium, tungsten, or vanadium, and mixtures thereof.

The magnetic substance have a number average particle diameter of 2.00 μm or less and preferably 0.05 μm or more and 0.50 μm or less. The content of the magnetic substance incorporated in the toner is preferably 20 parts by mass or more and 200 parts by mass or less with respect to 100 parts by mass of the binder resin and is particularly preferably 40 parts by mass or more and 150 parts by mass or less with respect to 100 parts by mass of the binder resin.

In addition, the toner particles according to the present invention may contain the following pigments to use as non-magnetic toner particles. Specific examples of the pigment include the following.

Examples of the coloring pigment for magenta include the following.

A condensed azo compound, a diketopyrrolopyrrole compound, anthraquinone, a quinacridone compound, a lake compound of basic dyes, a naphthol compound, a benzimidazolone compound, a thioindigo compound, and a perylene compound are exemplified.

Specific examples include the following: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, and 269; C.I. Pigment Violet 19; and C.I. Bat Red 1, 2, 10, 13, 15, 23, 29, and 35. Further, the following pigments may also be used.

As the dye for magenta toner, the following are exemplified: oil soluble dye such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40; C.I. Basic Violet 1, 3, 7, 10, 14, 15, 21, 25, 26, 27, and 28.

As the coloring pigment for cyan, the following are exemplified: C.I. Pigment Blue 1, 2, 3, 7, 15:2, 15:3, 15:4, 16, 17, 60, 62, and 66; C.I. Bat Blue 6; C.I. Acid Blue 45, and a copper phthalocyanine pigment whose phthalocyanine skeleton is substituted with 1 to 5 phthalimide methyl groups.

As the coloring pigment for yellow, the following are exemplified: a condensed azo compound, an isoindolinone compound, an anthraquinone compound, an azo metallic compound, a methine compound, or an allylamide compound. Specific examples include the following: C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191; and C.I. Bat Yellow 1, 3, and 20. Further, dyes such as C.I. Direct Green 6, C.I. Basic Green 4, C.I. Basic Green 6, and C.I. Solvent Yellow 162 can also be used.

For example, carbon black, or a colorant with its color adjusted to black by using the coloring pigment for yellow, coloring pigment for magenta, and coloring pigment for cyan described above is used as a black colorant.

The coloring pigment or the like except the above magnetic substance is used in an amount of preferably 0.1 part by mass or more and 30.0 parts by mass or less, more preferably 0.5 part by mass or more and 25.0 parts by mass or less, or most preferably 3.0 parts by mass or more and 20.0 parts by mass or less with respect to 100 parts by mass of the binder resin.

In the toner of the present invention, a known charge control agent can be used for stabilizing the charging performance of the toner. The charge control agent is incorporated in an amount of preferably 0.1 part by mass or more and 10.0 parts by mass or less, or more preferably 0.1 part by mass or more and 5.0 parts by mass or less with respect to 100 parts by mass of the binder resin of the toner, though the preferable amount varies depending on, for example, the kind of the charge control agent and the physical properties of any other component of the toner. Such charge control agents are known to be classified into an agent for controlling the toner so that the toner may be negatively chargeable and an agent for controlling the toner so that the toner may be positively chargeable, and one or two or more kinds of various charge control agents can be used in accordance with the kind and applications of the toner. It should be noted that the charge control agent may be internally or externally added to the toner.

An organic metal compound, a chelate compound, a polymer-type compound having sulfonic acid or carboxylic acid at a side chain are effectively used as a charge control agent for controlling a toner to be negatively chargeable. More specific examples of the charge control agent include a monoazo metal compound, an acetylacetone metal compound, a metal compound of aromatic hydroxycarbonate, a metal compound of aromatic dicarbonate, and polymer-type compounds having sulfonic acid or carboxylic acid at a side chain. Examples of the other charge control agents include: aromatic hydroxycarbonate, aromatic monocarbonate and aromatic polycarbonate, their metal salts, anhydrides, and esters; and phenol derivatives such as bisphenol.

An azo-based metal compound represented by the following general formula (1) is also preferably used.

[Chem 1]

(1)

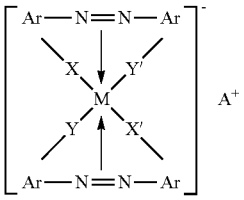

In the formula, M represents a coordination center metal, and examples of the coordination center metal include Sc, Ti, V, Cr, Co, Ni, Mn, and Fe, Ar represents an aryl group such as a phenyl group or a naphthyl group, and the aryl group may have a substituent such as a nitro group, a halogen group, a carboxyl group, an anilide group, or an alkyl or alkoxy group having 1 to 18 carbon atoms, X, X', Y, and Y' each represent —O—, —CO—, —NH—, or —NR— (where R represents an alkyl group having 1 to 4 carbon atoms), and a counter ion ($A^+$) is, for example, a hydrogen ion, a sodium ion, a potassium ion, an ammonium ion, an aliphatic ammonium ion, or a mixture of two or more of them; provided that the counter ion is not necessarily needed, and may be absent.

In particular, the above coordination center metal is preferably Fe or Cr, the substituent of the aryl group is preferably a halogen, an alkyl group, or an anilide group, and the counter ion ($A^+$) is preferably a hydrogen ion, an alkali metal ion, an ammonium ion, or an aliphatic ammonium ion. A mixture of compounds having different counter ions is also preferably used.

Further, a metal compound in which a metal element is coordinated and/or bonded to an aromatic hydroxycarboxylic acid represented by the following general formula (2) also imparts negative charging performance, and hence can be suitably used.

[Chem 2]

General formula (2)

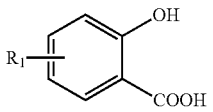

In the general formula (2), $R_1$ represents hydrogen, an alkyl group, an aryl group, an alalkyl group, a cycloalkyl group, an alkenyl group, an alkoxy group, an aryloxy group, a hydroxyl group, an acyloxy group, an alkoxycarbonyl group, an aryloxycarbonyl group, an acyl group, a carboxyl group, a halogen, a nitro group, an amino group, or a carbamoyl group, substituents $R_1$ may be linked to each other to form an aliphatic ring, aromatic ring, or heterocyclic ring, and, in this case, the ring may have another substituent $R_1$, the number of substituents $R_1$ may be 1 to 8, and the substituents may be identical to or different from each other.

The above metal element coordinated and/or bonded to the aromatic hydroxycarboxylic acid is preferably Cr, Co, Ni, Mn, Fe, Zn, Al, B, Zr, or Hf, or more preferably Cr, Fe, Zn, Al, Zr, or Hf.

An azo-based iron compound represented by the following general formula (3) is most preferably used as the azo-based metal compound represented by the above general formula (1).

[Chem 3]

(3)

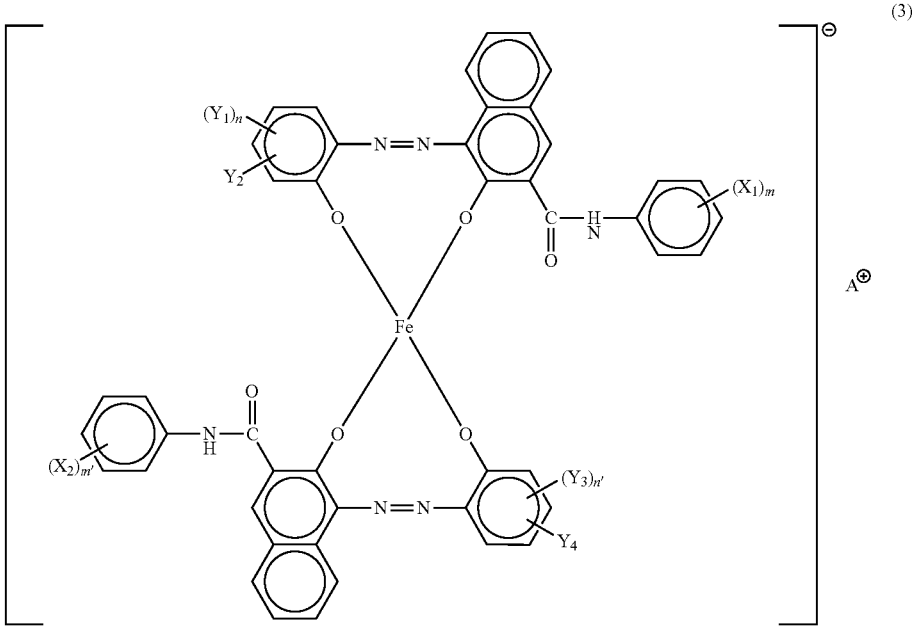

[In the formula:

$X_1$ and $X_2$ each represent a hydrogen atom, a lower alkyl group, a lower alkoxy group, a nitro group, or a halogen atom, and m and m' each represent an integer of 1 to 3;

$Y_1$ and $Y_3$ each represent a hydrogen atom, an alkyl group having 1 to 18 carbon atoms, an alkenyl group having 2 to 18 carbon atoms, a sulfoneamide group, a mesyl group, a sulfonic group, a carboxyester group, a hydroxy group, an alkoxy group having 1 to 18 carbon atoms, an acetylamino group, a benzoyl group, an amino group, or a halogen atom, and n and n' each represent an integer of 1 to 3 (in the foregoing description, $X_2$ and $X_4$, m and m', $Y_1$ and $Y_3$, n and n', or $Y_2$ and $Y_4$ may be identical to or different from each other); and $A^{\oplus}$ represents an ammonium ion, an alkali metal ion, a hydrogen ion, or a mixed ion of two or more of them.]

In addition, specific examples of the azo-based iron compound represented by the above general formula (3) are shown below.

[Chem 4]

Monoazo iron compound (1)

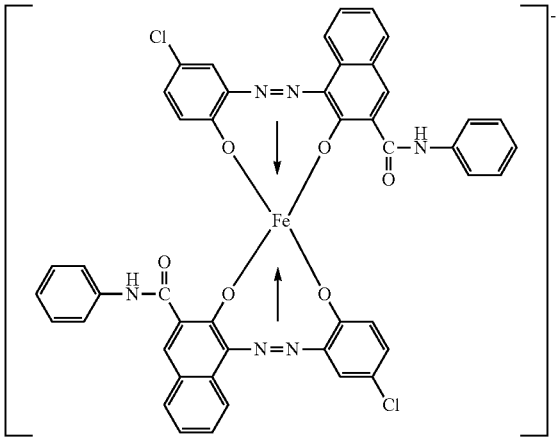

$NH_4^+$ (and $H^+$, $Na^+$, $K^+$, or a mixed ion of two or more of them)

Monoazo iron compound (2)

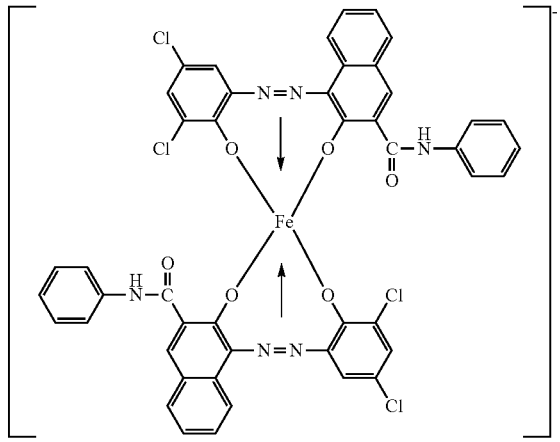

$NH_4^+$ (and $H^+$, $Na^+$, $K^+$, or a mixed ion of two or more of them)

Monoazo iron compound (3)

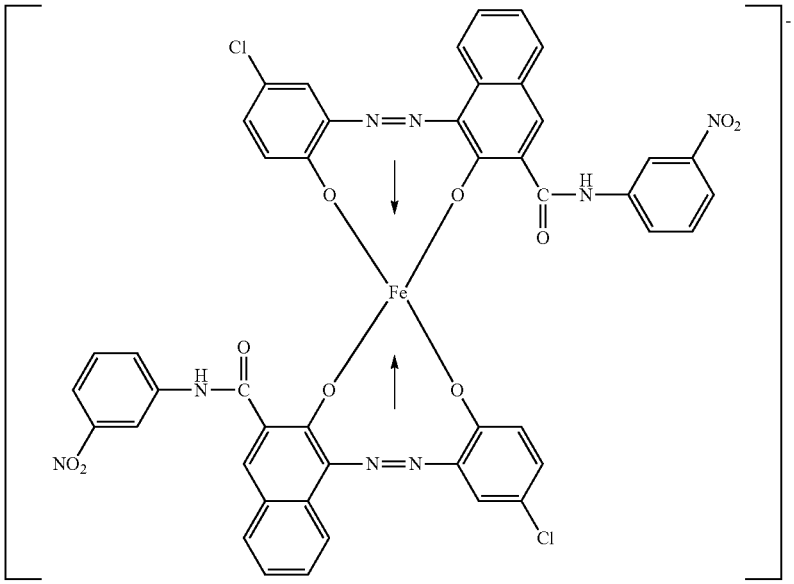

$NH_4^+$ (and $H^+$, $Na^+$, $K^+$, or a mixed ion of two or more of them)

-continued

[Chem 5]

Monoazo iron compound (4)

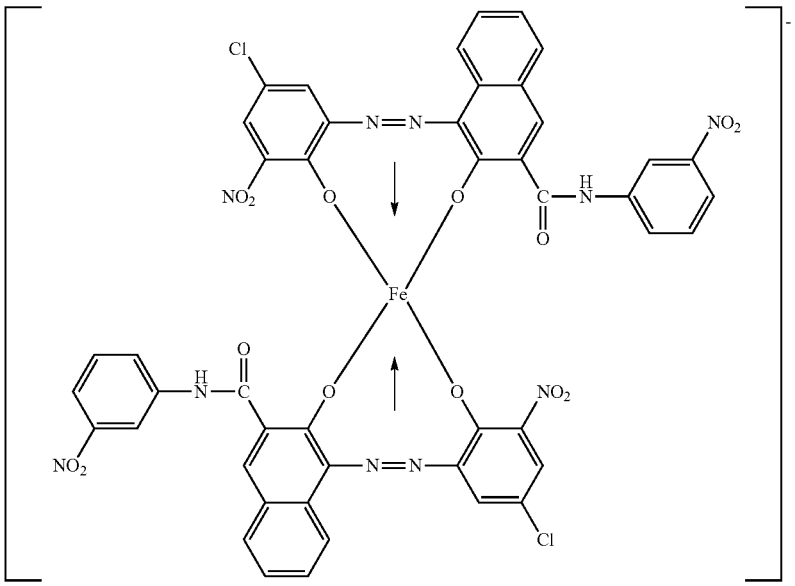

$NH_4^+$ (and $H^+$, $Na^+$, $K^+$, or a mixed ion of two or more of them)

Monoazo iron compound (5)

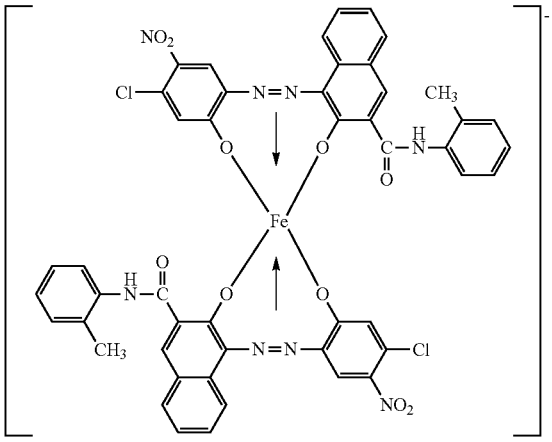

$NH_4^+$ (and $H^+$, $Na^+$, $K^+$, or a mixed ion of two or more of them)

Monoazo iron compound (6)

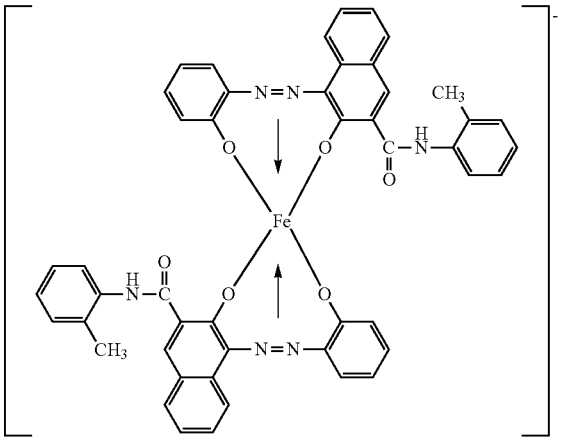

$NH_4^+$ (and $H^+$, $Na^+$, $K^+$, or a mixed ion of two or more of them)

On the other hand, as the charge control agent for controlling a toner to be positively chargeable, quaternary ammonium salts, polymer-type compound having a quaternary ammonium salt at a side chain, a guanidine compound, an imidazole compound, and a triphenyl methane compound.

In view of improving toner flowability, transfer property, and charge stability of the toner in the present invention, an external additive is mixed to the toner particles with a mixer such as a Henschel mixer. As the external additive, a known one can be used and the following fine powder can be favorably used. Examples thereof include: fluorine-based resin powder such as fluorinated vinylidene fine powder and polytetrafluoroethylene fine powder; titanium oxide fine powder; alumina fine powder; silica fine powder such as wet process silica, and dry process silica; and fine powder of their surface processed with silane compound, an organic silicon compound, a titanium coupling agent, and silicon oil.

Titanium oxide fine powder obtained by a sulfuric acid method, a chlorine method, or the low-temperature oxidation (thermal decomposition or hydrolysis) of volatile titanium compounds such as titanium alkoxide, titanium halide, and titanium acetylacetonate are used as the titanium oxide fine powder. Any one of the crystal systems including an anatase type, a rutile type, a mixed crystal of them, and an amorphous type can be used.

An alumina fine powder obtained by a Bayer method, an improved Bayer method, an ethylene chlorohydrin method, an underwater spark discharge method, an organic aluminum hydrolysis method, an aluminum alum thermal decomposition method, an ammonium aluminum carbonate thermal decomposition method, or a flame decomposition method for aluminum chloride is used as the alumina fine powder. Any one of the crystal systems including α, β, γ, δ, ξ, η, θ, κ, χ, and ρ types, a mixed crystal of them, and an amorphous type is used; an α, δ, γ, or θ type, a mixed crystal of them, or an amorphous type is preferably used.

The surface of the above fine powder is preferably subjected to a hydrophobic treatment with, for example, a coupling agent, silicone oil, or an organic silicon compound. A method for the hydrophobic treatment for the surface of the fine powder is, for example, a method involving chemically or physically treating the surface with, for example, an organic silicon compound that reacts with or physically adsorbs to the fine powder.

As the organic silicon compound, the following are exemplified: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane which has 2 to 12 siloxane units per molecule and contains a hydroxyl group bound to Si within a unit located in each of terminals. One of those compounds is used alone or mixture of two or more thereof is used.

The above fine powder subjected to a hydrophobic treatment is particularly preferably used as an external additive in the toner of the present invention in order that the above-mentioned surface tension index may be adjusted to fall within a specific range.

The above external additive has a specific surface area measured by a BET method based on nitrogen adsorption of preferably 10 $m^2/g$ or more, or more preferably 30 $m^2/g$ or more from the viewpoint of the impartment of characteristics.

The external additive is added in an amount of preferably 0.1 part by mass or more and 8.0 parts by mass or less, or more preferably 0.1 part by mass or more and 4.0 parts by mass or less with respect to 100 parts by mass of the toner particles.

In addition, the external additive preferably has a number-average primary particle diameter (D1) of 0.01 μm or more and 0.30 μm or less from the viewpoint of the impartment of flowability.

In addition, a two-component developer of the present invention is characterized by containing a magnetic carrier and the above toner of the present invention. The two-component developer using the toner of the present invention can provide an image which: has improved dot reproducibility; and is stable over a long time period.

The magnetic carrier used in the two-component developer of the present invention preferably has a contact angle relative to water of 80° or more and 125° or less.

When the contact angle of the magnetic carrier relative to water falls within the above range, a balance between toner release and toner scattering becomes particularly good, and a two-component developer capable of favorably maintaining excellent developing performance even at the time of a durability test under a high-temperature, high-humidity environment (having a temperature of 32.5° C. and a humidity of 80% RH) can be obtained.

The magnetic carrier preferably has such a constitution that the surface of each core particle is coated with a resin component in order that the above contact angle of the magnetic carrier relative to water may be controlled to fall within the above range.

A known carrier core particle can be used in the above magnetic carrier. Specific examples of the particle include: an iron powder having an oxidized or unoxidized surface; metal particles eachmade of, for example, iron, lithium, calcium, magnesium, nickel, copper, zinc, cobalt, manganese, chromium, or a rare earth element, alloy particles each made of two or more of the elements, or oxide particles each made of any one of the elements; ferrite; and a magnetic substance-dispersed resin carrier (the so-called resin carrier) obtained by dispersing a magnetic substance in a binder resin.

As the resin component covering a carrier core particle surface, thermoplastic resins and curing resins are exemplified.

Examples of the thermoplastic resin include polystyrene and acrylic resins such as polymethyl methacrylate and a styrene-acrylic acid copolymer, a styrene-butadiene copolymer, an ethylene-vinyl acetate copolymer, vinyl chloride, vinyl acetate, a polyvinylidene fluoride resin, a fluorocarbon resin, a perfluorocarbon resin, a solvent-soluble perfluorocarbon resin, a polyvinyl alcohol, polyvinyl acetal, polyvinyl pyrrolidone, a petroleum resin, cellulose, cellulose derivatives such as cellulose acetate, cellulose nitrate, methyl cellulose, hydroxymethyl cellulose, hydroxyethyl cellulose, and hydroxypropyl cellulose, a novolac resin, a low-molecular-weight polyethylene, a saturated alkyl polyester resin, aromatic polyester resins such as polyethylene terephthalate, polybutylene terepthalate, and polyacrylate, a polyamide resin, a polyacetal resin, a polycarbonate resin, a polyether sulfone resin, a polysulfone resin, a polyphenylene sulfide resin, and a polyether ketone resin.

Examples of the curing resin include a phenol resin, a modified phenol resin, a maleic resin, an alkyd resin, an epoxy resin, an acrylic resin, an unsaturated polyester obtained by polycondensation of maleic anhydride, terephthalic acid, and polyhydric alcohol, a urea resin, a melamine resin, a urea-melamine resin, a xylene resin, a toluene resin, a guanamine resin, a melamine-guanamine resin, an acetoganamine resin, a glyptal resin, a furan resin, a silicone resin, a polyimide resin, a polyamideimide resin, a polyether imide resin, and a polyurethane resin. Those resins may be used alone or two or more of them may be mixed before use. In addition, a thermoplastic resin is mixed with a curing agent or the like and cured before use.

In addition, a fine particle may be added to the resin component with which the surface of each carrier core particle is coated. Any one of the organic and inorganic fine particles can be used as the fine particle, but the shape of the particle must be kept upon coating of the surface of each carrier core particle. A crosslinked resin particle or an inorganic fine particle can be preferably used. To be specific, one kind of a fine particle made of a resin selected from a crosslinked polymethyl methacrylate resin, a crosslinked polystyrene resin, a melamine resin, a phenol resin, and a nylon resin, or made of an inorganic substance selected from, for example, silica, titanium oxide, and alumina can be used alone, or two or more kinds of such resin fine particles and inorganic fine particles can be used as a mixture. Of those, fine particles each made of a crosslinked polymethyl methacrylate resin, a crosslinked polystyrene resin, or a melamine resin are preferable from the viewpoint of the charge stability of the toner.

Those fine particles are preferably incorporated and used in an amount of 1 part by mass or more and 40 parts by mass or less with respect to 100 parts by mass of the coat resin. When the fine particles are used in an amount in the range, the charge stability and toner release can be improved, and image defects such as blank dots can be prevented. When the amount is less than 1 part by mass, an effect of adding the fine particles cannot be obtained. When the amount exceeds 40 parts by mass, the dropout of the coat layer occurs during a durability test, with the result that the toner tends to be poor in durability.

In addition, the resin component with which the surface of each carrier core particle is coated may contain conductive fine particles from the viewpoint of charge control.

As the conductive particles, specifically, particles containing at least one or more kinds of particles selected from carbon black, magnetite, graphite, titanium oxide, alumina, zinc oxide, and tin oxide are preferred. In particular, as particles having conductivity, carbon black can be preferably used because it has a small particle size and does not inhibit unevenness on the carrier surface due to fine particles.

The above magnetic carrier preferably has an intensity of magnetization in a magnetic field of $1{,}000/4\pi$ (kA/m) of 30 $Am^2/kg$ or more and 70 $Am^2/kg$ or less. When the intensity of magnetization of the magnetic carrier falls within the above range, images each having good dot reproducibility can be obtained over an additionally long time period.

The above magnetic carrier preferably has a 50% particle diameter on a volume basis (D50) of 20 μm or more and 70 μm or less from the viewpoints of the triboelectric charging performance of the toner, the adhesion of the carrier to an image region, and the prevention of fogging.

In the case of the two-component developer of the present invention, a mixing ratio between the toner and the magnetic carrier is such that a toner concentration in the developer is preferably 2 mass % or more and 15 mass % or less, or more preferably 4 mass % or more and 13 mass % or less.

Hereinafter, a method of producing the toner of the present invention will be described. However, the present invention is not limited to the following description.

The toner of the present invention can be produced by selecting appropriate materials or suitable production conditions in a known method. For example, the toner particles can be obtained through: a raw material mixing step of mixing the binder resin and the wax, and an arbitrary material; a melt kneading step of melting and kneading the resultant mixture; a pulverizing step of cooling and pulverizing the molten kneaded product; a treating step of spheroidizing, and/or treating the surfaces of, the resultant pulverized products; and a classifying step of classifying the treated products. Then, the toner can be produced by mixing the resultant toner particles with the external additive. It should be noted that the toner particles according to the present invention are more preferably obtained by performing a surface treatment with hot air.

Hereinafter, an example of the production example is described.

In the raw material mixing step in which a raw material supplied to the melting and kneading step is mixed, at least a binder resin and wax are weighed in a predetermined weight, blended, and mixed with a mixer.

Examples of the mixer include a double-cone mixer, a V-type mixer, a dram-type mixer, a super mixer, a Henschel mixer, and an NAUTA mixer.

Further, the toner raw material mixed are melted and kneaded to melt resins, and a wax or the like is dispersed therein. In the melting and kneading step, for example, a batch-type milling machine such as a compression kneader and a Banbury mixer or a continuos-type milling machine can be used. In recent years, unaxial or biaxial extruders are mainly used in view of the advantage of continuous production and the like. For example, a KTK-type biaxial extruder (manufactured by Kobe Steels, Ltd.), a TEM-type biaxial extruder (manufactured by Toshiba Machine Co., Ltd.), a biaxial extruder (manufactured by KCK.), a co-kneader (manufactured by Buss), and the like are generally used. Further, the resin composition obtained by melting and kneading a toner raw material is rolled with a two rolls or the like after melting and kneading, and cooled through a cooling step involving cooling with ice water or the like.

The resultant cooled product of the resin composition is subsequently pulverized into particles having a desired particle size in the pulverizing step. In the pulverizing step, the resultant is first coarsely pulverized with a crusher, a hammer mill, a feather mill, and the like. Further, the resultant is pulverized with a Kryptron system (manufactured by Kawasaki Heavy Industries), a Super rotor (manufactured by Nisshin Engineering Inc.), or the like, whereby a pulverized product is obtained.

After that, as required, the pulverized product is classified using a screen classifier such as a classifier including an Elbow jet (manufactured by Nittetsu Mining Co., Ltd.) which is an inertia classifying system and a Turboplex (manufactured by Hosokawa Micron Corporation) which is a centrifugal classifying system, whereby toner particles are obtained.

The toner particles used in the present invention are preferably obtained by: treating the surfaces of the above pulverized products with hot air; and classifying the treated products. Alternatively, a method involving treating the surfaces of products classified in advance with hot air is also preferable.

The above surface treatment with hot air is preferably performed by the following method: the toner is ejected by injection from a high-pressure air-feeding nozzle, and the ejected toner is exposed to the hot air so that the surface of the toner may be treated. The temperature of the hot air particularly preferably falls within the range of 100° C. or higher to 450° C. or lower.

Here, the outline of a surface treatment apparatus that can be used in the production of the toner of the present invention will be described with reference to FIGS. 1 and 2.

Figure 2:
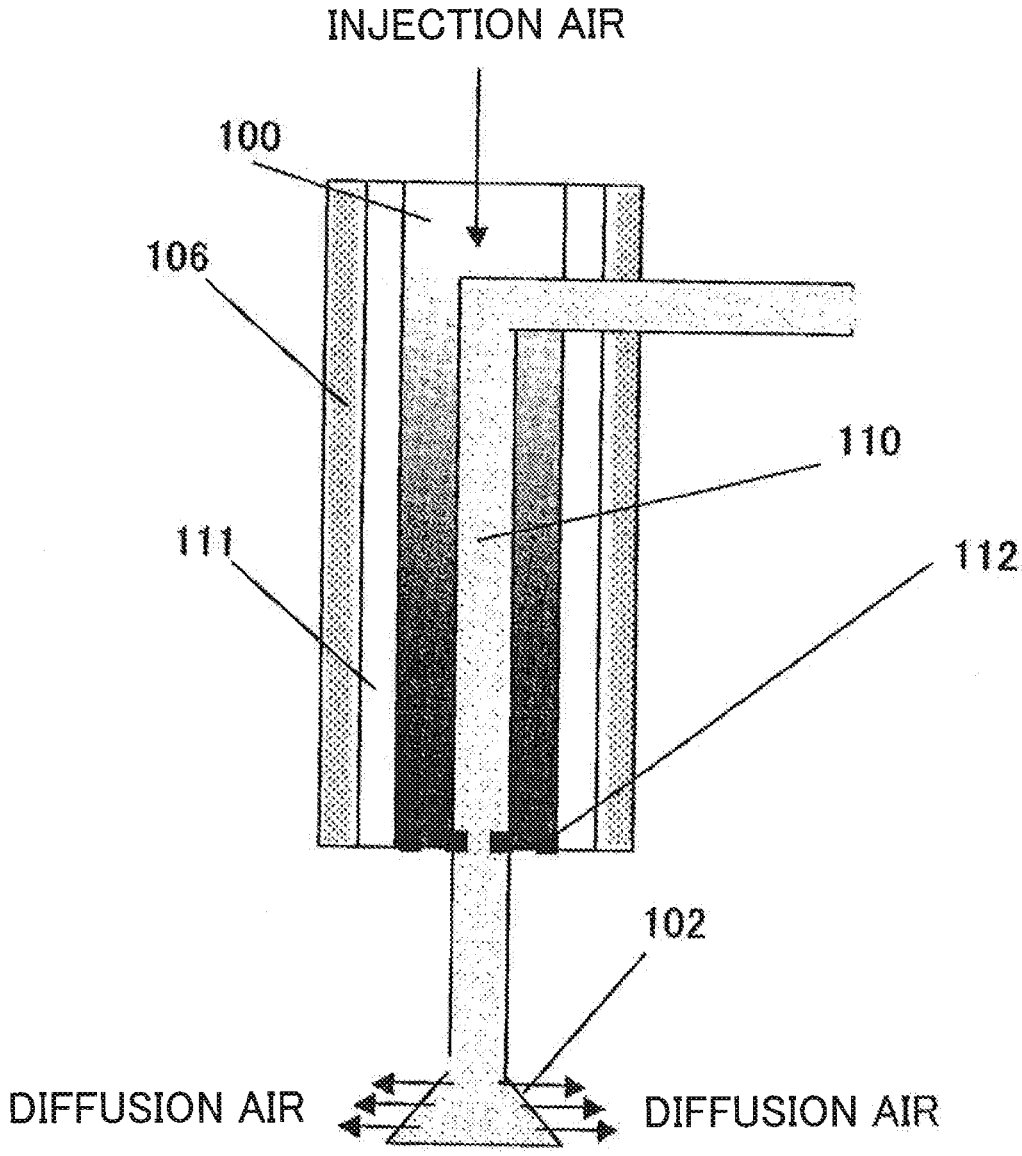
FIG. 2 shows an outline sectional view of a toner-feeding port and an airflow-injecting member in the surface treatment apparatus of the present invention.

FIG. 1 is a sectional view showing an example of the surface treatment apparatus according to the present invention, and FIG. 2 shows a sectional view showing an example of an airflow-injecting member.

A toner 114 fed from a toner-feeding port 100 is accelerated by an injection air injected from a high-pressure air-feeding nozzle 115 to move toward an airflow-injecting member 102 below the nozzle. As shown in FIG. 2, a diffusion air 110 is injected from the airflow-injecting member 102, and the toner is diffused upward and to the outside by the diffusion air 110. At this time, the state of diffusion of the toner can be controlled by adjusting the flow rate of the injection air and the flow rate of the diffusion air.

Further, the outer periphery of the toner-feeding port 100, the outer periphery of the surface treatment apparatus, and the outer periphery of a transfer pipe 116 are each provided with a cooling jacket 106 intended for the prevention of the melt adhesion of the toner. It should be noted that cooling water (preferably an antifreeze such as ethylene glycol) is preferably passed through the cooling jacket.

In addition, the surface of the toner diffused by the diffusion air is treated with hot air fed from a hot air-feeding port 101. At this time, a temperature C (° C.) in the hot air-feeding port is preferably 100° C. or higher and 450° C. or lower, or more preferably 100° C. or higher and 400° C. or lower. When the temperature falls within the above temperature range, the surface of each toner particle can be uniformly treated while the coalescence of the toner particles is suppressed.

The toner the surface of which has been treated with the hot air is cooled with cold air fed from a cold air-feeding port 103 provided for the outer periphery of the upper portion of the apparatus. At this time, cold air may be introduced from a second cold air-feeding port 104 provided for the side surface of the main body of the apparatus for the purposes of managing the temperature distribution in the apparatus and controlling the surface state of the toner. A slit shape, a louver shape, a porous plate shape, a mesh shape, or the like can be used in the outlet of the second cold air-feeding port 104, and the direction in which the cold air is introduced can be chosen from a horizontal direction toward the center of the apparatus and the direction along the wall surface of the apparatus in accordance with a purpose.

At this time, a temperature E (° C.) in each of the cold air-feeding port and the second cold air-feeding port described above is preferably −50° C. or higher and 10° C. or lower, or more preferably −40° C. or higher and 8° C. or lower. In addition, the above cold air is preferably dehumidified cold air. To be specific, the cold air has an absolute moisture content of preferably 5 g/m$^3$ or less, or more preferably 3 g/m$^3$ or less. Controlling the absolute moisture content of the cold air can easily adjust the surface tension index of the toner surface.

Setting the temperature within the above temperature range achieves a moderate treatment and the prevention of the melt adhesion of the toner to the wall surface in a balanced fashion.

After that, the cooled toner is sucked with a blower, and is recovered with a cyclone or the like through the transfer pipe 116.

Next, an airflow-injecting portion included in the surface treatment apparatus will be described with reference to FIG. 2. FIG. 2 is a sectional view showing an example of an airflow-injecting member.

As shown in FIG. 2, the toner fed from the upper portion of the toner-feeding port 100 by a quantitative feeder is accelerated in the port by the injection air to move toward an outlet portion, and is then diffused to the outside by the diffusion air from the airflow-injecting member 102 placed in the apparatus. It should be noted that the bottom edge of the airflow-injecting member 102 is preferably provided below the toner-feeding port 100 at a distance in the range of 5 mm or more to 150 mm or less from the bottom edge of the port. When the bottom edge of the airflow-injecting member is connected at a position at a distance of less than 5 mm from the outlet, setting the throughput of the toner to be introduced into the apparatus at a high level may cause clogging or a treatment failure. In addition, when the distance exceeds 150 mm, an effect of hot air for treating the toner diffused by the diffusion air may not be uniformly obtained, and hence the extent to which the toner is treated fluctuates, and the transferring performance of the toner reduces in some cases.

In addition, an airflow-feeding port 111 intended for the prevention of condensation may be provided for the outer periphery of the toner-feeding port 100 between the toner-feeding port 100 and the cooling jacket 106. The airflow for the prevention of condensation may be introduced from a feeder common to the diffusion air or to the above cold air and second cold air, or external air may be taken by opening an intake. Alternatively, the apparatus can be operated in a state where the intake is closed so that buffer air may flow in the apparatus.

In addition, surface modification and a sphering treatment may be further performed with, for example, a Hybridization System manufactured by NARA MACHINERY CO., LTD. or a Mechanofusion System manufactured by Hosokawa Micron Corporation as required. In the case, a screen classifier such as a Hi-bolter (manufactured by Shin Tokyo Kikai KK) as an airflow type sieve may be used as required.

Meanwhile, a method of externally treating the above external additive is, for example, the following method: predetermined amounts of the classified toner particles and various known external additives are blended with each other, and are then stirred and mixed by using a high-speed stirrer for applying a shear force to a powder such as a Henschel mixer or a Super mixer as an external adding machine.

Methods of measuring various physical properties of the above toner will be described below.

<Methods of Measuring Average Surface Roughness (Ra) and Ten Point Height of Roughness (Rz) of Surfaces of Toner Particles>

The average surface roughness (Ra) and ten point height of roughness (Rz) of the surfaces of toner particles were measured with the following measuring apparatus under the following measurement conditions.

Scanning probe microscope: Probe Station SPI 3800N (manufactured by Seiko Instruments Inc.)

| | |
|---|---|
| Measuring unit: | SPA 400 |
| Measurement mode: | DFM (resonance mode) shape image |
| Cantilever: | SI-DF 40P |
| Resolution: | Number of pieces of X data 256<br>Number of pieces of Y data 128 |
| Measurement area: | 1-μm square |

In the case of a toner containing toner particles to each of which an external additive is added, the external additive must be removed in advance. A specific method employed is as described below.

(1) 45 mg of the toner are loaded into a sample bottle, and 10 ml of methanol are charged into the bottle.

(2) The sample is dispersed with an ultrasonic cleaner for 1 minute so that the external additive may be separated.

(3) Each toner particle and the external additive are separated from each other by suction filtration (with a 10-μm membrane filter). In the case of a toner containing a magnetic substance, only a supernatant may be separated by bringing a magnet into contact with the bottom of the sample bottle to fix the toner particles.

(4) The above operations (2) and (3) are each performed three times in total, and the resultant toner particles are sufficiently dried with a vacuum dryer at room temperature.

Another method of removing the external additive which replaces the above operations (2) and (3) is, for example, a method involving dissolving the external additive with an alkali. An aqueous solution of sodium hydroxide is preferably used as the alkali.

In addition, a toner particle having a particle diameter equal to the weight-average particle diameter (D4) of the toner particles measured by a Coulter Counter method to be described later was selected and defined as a measuring object. Measured data was processed as follows: ten or more different toner particles were subjected to measurement, and the average values of the resultant data were calculated and used as the average surface roughness (Ra) and ten point height of roughness (Rz) of the toner particles.

The average surface roughness (Ra) is an expanded version of a center line average roughness Ra defined in JIS B0601 (1994) to three dimensions so that the center line average roughness may be applicable to a measuring surface. The average surface roughness is the average of the absolute values of deviations from a reference surface to a designated surface, and is represented by the following equation.

$$Ra = \frac{1}{S_0}\int_{Y_B}^{Y_T}\int_{X_L}^{X_R}|F(X, Y) - Z_0|dX\,dY \quad \text{[Num 1]}$$

F(X, Y): Area represented by all measured data $S_0$: Area of the designated surface when it is assumed that the designated surface is ideally flat $Z_0$: Average of Z data (roughness data) in the designated surface The term "designated surface" as used in the present invention refers to a 1-μm square measurement area.

Figure 3:
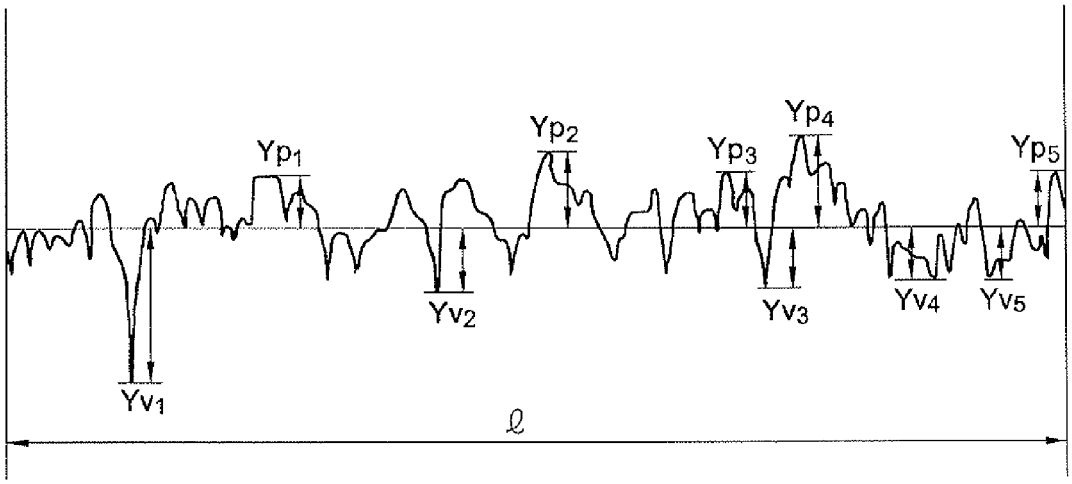
FIG. 3 is a graph showing a roughness curve of a toner of the present invention.

Meanwhile, the ten point height of roughness (Rz) was measured in conformance with the definition in JIS B0601 (1994). That is, the ten point height of roughness was determined by the following procedure. Only a reference length was sampled from a roughness curve in the direction of the average line of the curve. See FIG. 3. The absolute values of the altitudes (Yp) of the first to fifth highest peaks were measured in the direction perpendicular to the average line of the sampled portion, and the measured values were averaged. Similarly, the absolute values of the altitudes (Yv) of the first to fifth lowest valleys were measured in the direction, and the measured values were averaged. Then, the sum of the averages was determined, whereby the ten point height of roughness was determined.

$$R_Z = \frac{|Y_{p1+}Y_{p2+}Y_{p3+}Y_{p4+}Y_{p5}| + |Y_{V1+}Y_{V2+}Y_{V3+}Y_{V4+}Y_{V5}|}{5} \quad \text{[Num 2]}$$

<Method of Measuring Weight Average Particle Diameter (D4) of Toner>

The weight average particle diameter (D4) of the toner was measured with a precision grain size distribution measuring apparatus based on a pore electrical resistance method provided with a 100-μm aperture tube "Coulter Counter Multisizer 3" (registered trademark, manufactured by Beckman Coulter, Inc) and dedicated software included with the apparatus "Beckman Coulter Multisizer 3 Version 3.51" (manufactured by Beckman Coulter, Inc) for setting measurement conditions and analyzing measurement data while the number of effective measurement channels was set to 25,000, whereby the measured data was analyzed to calculate the particle diameter.

An electrolyte solution prepared by dissolving reagent grade sodium chloride in ion-exchanged water to have a concentration of about 1 mass %, for example, an "ISOTON II" (manufactured by Beckman Coulter, Inc) can be used in the measurement.

It should be noted that the dedicated software was set as described below prior to the measurement and the analysis.

In the "change of standard measurement method (SOM)" screen of the dedicated software, the total count number of a control mode was set to 50,000 particles, the number of times of measurement was set to 1, and a value obtained by using "standard particles each having a particle diameter of 10.0 μm" (manufactured by Beckman Coulter, Inc) was set as a Kd value. A threshold and a noise level were automatically set by pressing a "threshold/noise level measurement" button. In addition, a current was set to 1,600 μA, a gain was set to 2, and an electrolyte solution was set to an ISOTON II, and a check mark was placed in a check box as to whether the aperture tube was flushed after the measurement.

In the "setting for conversion frompulse to particle diameter" screen of the dedicated software, a bin interval was set to a logarithmic particle diameter, the number of particle diameter bins was set to 256, and a particle diameter range was set to the range of 2 μm to 60 μm.

A specific measurement method is as described below.

(1) About 200 ml of the electrolyte solution were charged into a 250-ml round-bottom beaker made of glass dedicated for the Multisizer 3. The beaker was set in a sample stand, and the electrolyte solution in the beaker was stirred with a stirrer rod at 24 rotations/sec in a counterclockwise direction. Then, dirt and bubbles in the aperture tube were removed by the "aperture flush" function of the analysis software.

(2) About 30 ml of the electrolyte solution were charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three mass-fold was added as a dispersant to the electrolyte solution.

(3) An ultrasonic dispersing unit "Ultrasonic Dispersion System Tetora 150" (manufactured by Nikkaki Bios Co., Ltd.) in which two oscillators each having an oscillatory frequency of 50 kHz were built so as to be out of phase by 180° and which had an electrical output of 120 W was prepared. A predetermined amount of ion-exchanged water was charged into the water tank of the ultrasonic dispersing unit. About 2 ml of the Contaminon N were added to the water tank.

(4) The beaker in the section (2) was set in the beaker fixing hole of the ultrasonic dispersing unit, and the ultrasonic dispersing unit was operated. Then, the height position of the beaker was adjusted in order that the liquid level of the electrolyte solution in the beaker might resonate with an ultrasonic wave from the ultrasonic dispersing unit to the fullest extent possible.

(5) About 10 mg of toner were gradually added to and dispersed in the electrolyte solution in the beaker in the section (4) in a state where the electrolyte solution was irradiated with the ultrasonic wave. Then, the ultrasonic dispersion treatment was continued for an additional 60 seconds. It should be noted that the temperature of water in the water tank was appropriately adjusted so as to be 10° C. or higher and 40° C. or lower upon ultrasonic dispersion.

(6) The electrolyte solution in the section (5) in which the toner had been dispersed was dropped with a pipette to the round-bottom beaker in the section (1) placed in the sample stand, and the concentration of the toner to be measured was adjusted to about 5%. Then, measurement was performed until the particle diameters of 50,000 particles were measured.

(7) The measurement data was analyzed with the dedicated software included with the apparatus, and the weight average particle diameter (D4) of the toner was calculated. It should be noted that an "average diameter" on the "analysis/volume statistics (arithmetic average)" screen of the dedicated software when the dedicated software was set to show a graph in a vol % unit was the weight average particle diameter (D4).

<Method of Measuring Average Circularity of Toner>

The average circularity of toner was measured with a flow-type particle image analyzer "FPIA-3000 model" (manufactured by SYSMEX CORPORATION) under the same measurement and analysis conditions as those at the time of a calibration operation for the apparatus.

A specific measurement method is as described below. A suitable amount of a surfactant, preferably a sodium dodecylbenzenesulfonate salt, as a dispersant, was added to 20 ml of ion-exchanged water, and then 0.02 g of a measurement sample was added to the mixture. The resultant mixture was subjected to a dispersion treatment with a desktop ultrasonic cleaning and dispersing machine having an oscillatory frequency of 50 kHz and an electrical output of 150 W (such as "VS-150" (manufactured by VELVO-CLEAR)) for 2 minutes, whereby a dispersion liquid for measurement was obtained. At that time, the dispersion liquid was appropriately cooled so as to have a temperature of 10° C. or higher and 40° C. or lower.

The flow-type particle image analyzer mounted with a standard objective lens (at a magnification of 10) was used in the measurement, and a particle sheath "PSE-900A" (manufactured by SYSMEX CORPORATION) was used as the sheath liquid. The dispersion liquid prepared in accordance with the procedure was introduced into the flow-type particle image analyzer, and the particle diameters of 3,000 toner particles were measured according to the total count mode of an HPF measurement mode. Then, the average circularity of the toner was determined with a binarization threshold at the time of particle analysis set to 85% and particle diameters to be analyzed limited to ones each corresponding to a circle-equivalent diameter of 2.00 μm or more and 200.00 μm or less.

Prior to the initiation of the measurement, automatic focusing was performed by using standard latex particles (obtained by diluting, for example, a "5100A" manufactured by Duke Scientific with ion-exchanged water). After that, focusing is preferably performed every two hours from the initiation of the measurement.

It should be noted that, in examples of the present invention, calibration was conducted by SYSMEX CORPORATION, a flow-type particle image analyzer which had received a calibration certificate issued by SYSMEX CORPORATION was used, and the measurement was performed under measurement and analysis conditions identical to those at the time of the reception of the calibration certificate except that particle diameters to be analyzed were limited to ones each corresponding to a circle-equivalent diameter of 2.00 μm or more and 200.00 μm or less.

The measurement principle of the flow-type particle image analyzer "FPIA-3000 type" (manufactured by SYSMEX CORPORATION) is as follows: flowing particles are photographed as a static image, and the image is analyzed. A sample added to a sample chamber is transferred to a flat sheath flow cell with a sample sucking syringe. The sample transferred to the flat sheath flow cell is sandwiched by sheath liquids to form a flat flow. The sample passing through the inside of the flat sheath flow cell is irradiated with stroboscopic light at an interval of 1/60 second, whereby flowing particles can be photographed as a static image. In addition, the particles are photographed in focus because the flow of the particles is flat. A particle image is photographed with a CCD camera, and the photographed image is subjected to image processing at such an image processing resolution that one field view is composed of 512×512 pixels (each pixel measuring 0.37 μm by 0.37 μm), whereby the border of each particle image is sampled. Then, the projected area S, perimeter L, and the like of each particle image are measured.

Next, with the value for the area S and perimeter L, a circle-equivalent diameter and a circularity are determined. The circle-equivalent diameter is defined as the diameter of a circle having the same area as that of the projected area of a particle image, the circularity C is defined as a value obtained by dividing the perimeter of a circle determined from the circle-equivalent diameter by the perimeter of a particle projected image, and the circle-equivalent diameter and the circularity are calculated from the following equations.

$$\text{Circularity } C=2\times(\pi\times S)^{1/2}/L$$

When a particle image is of a complete round shape, the circularity of the particle in the image becomes 1.000. With an increase in a perimeter unevenness degree of the particle image, the circularity of the particle decreases. After the circularities of the respective particles were calculated, the circularities in the range of 0.200 or more and 1.000 or less were divided into 800 sections. An additive average value of the obtained circularities was calculated, and the value was defined as the average circularity.

<Method of Measuring Surface Tension Index of Toner>

The surface tension index of the toner was calculated in the following manner.

About 5.5 g of toner were gently loaded into a measurement cell, and the cell was subjected to a tapping operation with a Tapping Machine PTM-1 model (manufactured by SANKYO PIO-TECH. CO., Ltd.) at a tapping speed of 30 times/min for 1 minute. A sample thus obtained was set in a measuring apparatus (WTMY-232A model Wet Tester, manufactured by SANKYO PIO-TECH. CO., Ltd.; an apparatus for measuring wettability of powder by a capillary suction time method) and measured. Each of the measurement conditions are as follows.

| | |
|---|---|
| Solvent | 45-vol % aqueous solution of methanol |
| Measurement mode | Constant flow rate method (A2 mode) |
| Liquid flow rate | 2.4 ml/min |
| Cell | Y-type measurement cell |

The surface tension index I (N/m) of the toner was calculated from the following equation (1) when the capillary pressure of the toner was represented by $P_\alpha$ (N/m$^2$), the specific surface area of the toner was represented by A (m$^2$/g), and the true density of the toner was represented by B (g/cm$^3$). It should be noted that the specific surface area and true density of the toner were measured by methods to be described later. It should be noted that the capillary pressure $P_\alpha$ (N/m$^2$) in the following equation is a value determined with the above measuring apparatus, and is the pressure at which the aqueous solution of methanol starts to infiltrate into a toner powder layer.

$$I=P_\alpha/(A\times B\times 10^6) \quad \text{Eq. (1)}$$

<Method of Measuring Specific Surface Area (BET Method) of Each of Toner and External Additive>

The specific surface area (BET method) of each of the toner and the external additive was measured with a specific surface area measuring apparatus Tristar 3000 (manufactured by Shimadzu Corporation).

The specific surface area of each of the toner and the external additive was measured as described below. A nitrogen gas was caused to adsorb to the surface of a sample in accordance with a BET method, and the specific surface area of the sample was calculated by employing a BET multipoint method. Prior to the measurement of the specific surface area, about 2 g of the sample were precisely weighed in a sample tube, and the tube was evacuated to a vacuum at room temperature for 24 hours. After the evacuation to a vacuum, the mass of the entire sample cell was measured, and the exact mass of the sample was calculated from a difference between the measured mass and the mass of an empty sample cell.

Next, the empty sample cell was set in each of the balance port and analysis port of the above measuring apparatus. Next, a Dewar flask containing liquid nitrogen was set at a predetermined position, and a saturated vapor pressure (P0) measurement command was used for measuring a P0. After the completion of the measurement of the P0, the prepared sample cell was set in the analysis port, and the sample mass and the P0 were input. After that, measurement was initiated by a BET measurement command. After that, the BET specific surface area was automatically calculated.

<Measurement of Particle Diameter of External Additive>

The particle diameter of the external additive was measured as described below. 500 or more particles each having a particle diameter of 1 nm or more were sampled at random with a scanning electron microscope (platinum-deposited, applied voltage 2.0 kV, magnification 50,000), and the longer diameter and shorter diameter of each particle were measured with a digitizer. The average of the longer diameter and the shorter diameter was defined as the particle diameter of each particle, and the number-average particle diameter (D1) of the 500 or more particles was calculated.

<Measurement of True Density of Toner>

The true density of the toner was measured with a dry automatic densimeter Autopycnometer (manufactured by Yuasa Ionics Inc.) under the following conditions.

| | |
|---|---|
| Cell | SM cell (10 ml) |
| Sample amount | About 2.0 g |

The measuring apparatus measures the true density of a solid or liquid on the basis of a vapor-phase substitution method. The vapor-phase substitution method, which is based on Archimedes' principle as in the case of a liquid-phase substitution method, shows high accuracy because a gas (argon gas) is used as a substitution medium.

<Method of Measuring Molecular Weight of Tetrahydrofuran (THF) Soluble Matter of Toner or Resin by Gel Permeation Chromatography (GPC)>

The molecular weight distribution of tetrahydrofuran (THF) soluble matter of a toner or a resin was measured by gel permeation chromatography (GPC) as described below.

First, the sample was dissolved in THF at room temperature over 24 hours. Then, the resultant solution was filtrated through a solvent-resistant membrane filter "Maishori Disk" (manufactured by TOSOH CORPORATION) having a pore diameter of 0.2 μm, whereby a sample solution was obtained. It should be noted that the concentration of a component soluble in THF in the sample solution was adjusted to about 0.8 mass %. Measurement of molecular weight distribution was performed by using the sample solution under the following conditions.

Apparatus: HLC8120 GPC (detector: RI) (manufactured by TOSOH CORPORATION)

Column: 7 consecutive columns of Shodex KF-801, 802, 803, 804, 805, 806, and 807 (manufactured by SHOWA DENKO K.K.)

Elution solution: tetrahydrofuran (THF)

Flow rate: 1.0 ml/minute

Oven temperature: 40.0° C.

Sample injection amount: 0.10 ml

Upon calculation of the molecular weight of the sample, a molecular weight calibration curve prepared with a standard polystyrene resin (such as a product available under the trade name "TSK Standard Polystyrene F-850, F-450, F-288, F-128, F-80, F-40, F-20, F-10, F-4, F-2, F-1, A-5000, A-2500, A-1000, or A-500" from TOSOH CORPORATION) was used.

<Method of Measuring Contact Angle of Magnetic Carrier Relative to Water>

The contact angle of the magnetic carrier relative to water was measured with a WTMY-232A model Wet Tester manufactured by SANKYO PIO-TECH. CO., Ltd.

13.2 g of the magnetic carrier were gently loaded into a measurement cell, and the cell was subjected to a tapping operation with a Tapping Machine PTM-1 model manufactured by SANKYO PIO-TECH. CO., Ltd. at a tapping speed of 30 times/min and an amplitude of 10 mm for 1 minute. A sample thus obtained was set in the measuring apparatus, and then measurement was performed.

First, the specific surface area of the powder layer was determined by an air permeation method, and then the pressure inflection point of the layer was determined by a constant flow rate method. The contact angle of the magnetic carrier relative to water was calculated from both of them.

<Method of Measuring Peak Temperature of Highest Endothermic Peak of Wax or Resin>

The peak temperature of the highest endothermic peak of the wax or resin was measured with a differential scanning calorimeter "Q1000" (manufactured by TA Instruments) in conformance with ASTM D3418-82.

A temperature correction for the detecting portion of the apparatus was performed by using the melting point of each of indium and zinc, and a heat quantity correction for the portion was performed by using the heat of melting of indium.

To be specific, about 10 mg of a sample were precisely weighed and loaded into an aluminum pan. The measurement was performed in the measurement temperature range of 30 to 200° C. at a rate of temperature increase of 10° C./min by using an empty aluminum pan as a reference. It should be noted that, in the measurement, the temperature was increased to 200° C. once, was subsequently decreased to 30° C., and was then increased again. The peak temperature of the highest endothermic peak was determined by using a DSC curve in the temperature range of 30 to 200° C. in the second temperature increase process.

<Method of Measuring Glass Transition Temperature (Tg) of Resin or Toner>

The glass transition temperature (Tg) of the resin or the toner was measured with a differential scanning calorimeter "Q1000" (manufactured by TA Instruments) in conformity with ASTM D3418-82.

A temperature correction for the detecting portion of the apparatus was performed by using the melting point of each of indium and zinc, and a heat quantity correction for the portion was performed by using the heat of melting of indium.

To be specific, about 10 mg of the sample were precisely weighed and loaded into an aluminum pan. The measurement was performed in the measurement temperature range of 30 to 200° C. at a rate of temperature increase of 10° C./min by using an empty aluminum pan as a reference. A change in specific heat was obtained in the temperature range of 40° C. to 100° C. in the temperature increase process. The point of intersection of a line intermediate between base lines before and after the appearance of the change in specific heat and the differential thermal curve in this case was defined as the glass transition temperature Tg.

<Method of Measuring Abundance of Wax on Toner Surface>

The abundance of the wax on the toner surface was determined by calculation on the basis of a composition ratio between toner materials and an element concentration on the toner surface measured by X-ray photoelectron spectrometer (ESCA).

An element concentration on the toner surface was measured with an apparatus for X-ray photoelectron spectrometer (ESCA) (Quantum 2000 manufactured by ULVAC-PHI, INCORPORATED) under the following conditions.

| | |
|---|---|
| Sample measuring range: | Φ100 μm |
| Photoelectron acceptance angle: | 45° |
| X-rays: | 50μ, 12.5 W, 15 kV |
| Pass Energy: | 46.95 eV |
| Step Size: | 0.200 eV |
| No. of Sweeps: | 1 to 20 |
| Set measuring time: | 30 min |

<Method of Measuring Average Primary Dispersed Particle Diameter of Wax in Toner Particles>

A specific method of measuring the average primary dispersed particle diameter of the wax in the toner particles is as described below. That is, the toner particles were sufficiently dispersed in a normal temperature-curable epoxy resin. After that, the resultant was cured in an atmosphere having a temperature of 40° C. for 2 days, and the resultant cured product was stained with triruthenium tetroxide and triosmium tetroxide. The cured product was cut into a flaky sample with a microtome equipped with diamond teeth, and the fault morphology of each toner particle was measured with a transmission electron microscope (TEM). The average primary dispersed particle diameter of the wax is determined as follows: 20 wax domains are selected at random, the area of each domain is measured with an image analyzer, the diameter of a circle having the same area as that of any one of the domains is defined as a circle-equivalent diameter, and the average of the circle-equivalent diameters is defined as the average primary dispersed particle diameter.

<Intensity of Magnetization of Magnetic Carrier>

The intensity of magnetization of the magnetic carrier was determined with a vibration magnetic field-type magnetic property apparatus "vibrating sample magnetometer" (VSM) (vibration magnetic field-type magnetic property automatic recorder BHV-30 manufactured by Riken Denshi. Co., Ltd.) by the following procedure.

The magnetic carrier was packed into a cylindrical plastic container so that the container was closely packed with the carrier to a sufficient extent and, on the other hand, an external magnetic field of 1,000/4π (kA/m) (1,000 ersted) was prepared. In the state, the magnetizing moment of the magnetic carrier packed in the container was measured. Further, an actual mass of the magnetic carrier packed in the container was measured, and the intensity of magnetization of the carrier ($Am^2/kg$) was determined.

<Method of Measuring 50% Particle Diameter (D50) on Volume Basis of Magnetic Carrier>

The 50% particle diameter (D50) on a volume basis of the magnetic carrier was measured with a multi-image analyzer (manufactured by Beckman Coulter, Inc) as described below.

A solution prepared by mixing a 1 mass % aqueous solution of NaCl and glycerin at 50 mass %:50 mass % was used as an electrolyte solution. Here, the aqueous solution of NaCl has only to be prepared by using first grade sodium chloride, or, for example, an ISOTON (registered trademark)-II (manufactured by Coulter Scientific Japan, Co.) may also be used as the aqueous solution of NaCl. Glycerin has only to be a reagent grade or first grade reagent.

0.5 ml of a surfactant (preferably alkylbenzenesulfonate) as a dispersant was added to the electrolyte solution (about 30 ml). Further, 10 mg of a measurement sample were added to the mixture. The electrolyte solution in which the sample had been suspended was subjected to a dispersion treatment with an ultrasonic dispersing unit for about 1 minute, whereby a dispersion liquid was obtained.

With the settings of the apparatus, which uses a 200-μm aperture as an aperture and a lens having a magnification of 20, the 50% particle diameter (D50) on volume basis of the magnetic carrier was calculated under the following measurement conditions.

| | |
|---|---|
| Average brightness in measurement frame: | 220 or more and 230 or less |
| Measurement frame setting: | 300 |
| Threshold (SH): | 50 |
| Binarization level: | 180 |

The electrolyte solution and the dispersion liquid were charged into a glass measurement container, and the concentration of the magnetic carrier particles in the measurement container was set to 10 vol %. The contents in the glass measurement container were stirred at the maximum stirring speed. A suction pressure for the sample was set to 10 kPa. When the magnetic carrier had so large a specific gravity as to be apt to sediment, a time period for the measurement was set to 20 minutes. In addition, the measurement was suspended every 5 minutes, and the container was replenished with the sample liquid and the mixed solution of the electrolyte solution and glycerin.

The numbers of measurement were 2,000. After the completion of the measurement, blurred images, agglomerated particles (multiple particles were simultaneously subjected to measurement), and the like were removed from a particle image screen with software in the main body of the apparatus. The circularity of the magnetic carrier was calculated from the following equation.

$$\text{Circle-equivalent diameter}=(4\cdot\text{Area}/\pi)^{1/2}$$

The term "Area" as used herein is defined as the projected area of a binarized magnetic carrier particle image and the circle-equivalent diameter is represented as the diameter of a true circle when the "Area" is regarded as the area of the true circle. The resultant individual circle-equivalent diameters are classified into 256 divisions ranging from 4 μm or more and 100 μm or less, and are plotted on a logarithmic graph on a volume basis. With this, a 50% particle diameter on a volume basis (D50) was determined.

EXAMPLES

Hereinafter, specific examples of the present invention are described. However, the present invention is not limited to these examples. It should be noted that the terms "part(s)" and "%" in the following formulations refer to "part(s) by mass" and "mass %", respectively unless otherwise stated.

Binder Resin Production Example 1

71.0 parts by mass of polyoxypropylene (2.2)-2,2-bis(4-hydroxyphenyl)propane, 28.0 parts by mass of terephthalic acid, 1.0 part by mass of trimellitic anhydride, and 0.5 part by mass of titanium tetrabutoxide as polyester unit components were loaded into a 4-l four-necked flask made of glass. The flask was equipped with a temperature gauge, a stirring rod, a condenser, and a nitrogen-introducing pipe, and was placed in a mantle heater. Next, the air in the flask was replaced with a nitrogen gas, and then the temperature in the flask was gradually increased while the mixture in the flask was stirred. While the mixture was stirred at a temperature of 200° C., the mixture was subjected to a reaction for 4 hours, whereby a resin 1-1 having a polyester unit was obtained. The resin 1-1 having a polyester unit had a weight-average molecular weight (Mw) of 80,000, a number average molecular weight (Mn) of 3,500, and a peak molecular weight (Mp) of 5,700.

In addition, 70.0 parts by mass of polyoxypropylene (2.2)-2,2-bis(4-hydroxyphenyl)propane, 20.0 parts by mass of terephthalic acid, 3.0 parts by mass of isophthalic acid, 7.0 parts by mass of trimellitic anhydride, and 0.5 part by mass of titanium tetrabutoxide as polyester unit components were loaded into a 4-l four-necked flask made of glass. The flask was equipped with a temperature gauge, a stirring rod, a condenser, and a nitrogen-introducing pipe, and was placed in a mantle heater. Next, the air in the flask was replaced with a nitrogen gas, and then the temperature in the flask was gradually increased while the mixture in the flask was stirred. While the mixture was stirred at a temperature of 220° C., the mixture was subjected to a reaction for 6 hours, whereby a resin 1-2 having a polyester unit was obtained. The resin 1-2 having a polyester unit had a weight-average molecular weight (Mw) of 120,000, a number average molecular weight (Mn) of 4,000, and a peak molecular weight (Mp) of 7,800.

50 parts by mass of the above polyester resin 1-1 and 50 parts by mass of the polyester resin 1-2 were preliminarily mixed with a Henschel mixer (manufactured by Mitsui Miike Machinery Co., Ltd.), and were then melted and blended with a melting kneader PCM30 (manufactured by Ikegai, Ltd.) at a number of revolutions of 3.3 and a resin-kneading temperature of 100° C., whereby a binder resin 1 was obtained.

Binder Resin Production Example 2

60.1 parts by mass of polyoxypropylene (2.2)-2,2-bis(4-hydroxyphenyl)propane, 14.3 parts by mass of polyoxyethylene (2.2)-2,2-bis(4-hydroxyphenyl)propane, 12.0 parts by mass of terephthalic acid, 3.2 parts by mass of trimellitic anhydride, 10.4 parts by mass of fumaric acid, and 0.3 part by mass of titanium tetrabutoxide as polyester unit components were loaded into a 4-l four-necked flask made of glass. The flask was equipped with a temperature gauge, a stirring rod, a condenser, and a nitrogen-introducing pipe, and was placed in a mantle heater. Next, the air in the flask was replaced with a nitrogen gas, and then the temperature in the flask was gradually increased while the mixture in the flask was stirred. While the mixture was stirred at a temperature of 200° C., the mixture was subjected to a reaction for 3 hours, whereby a binder resin 2 formed of a polyester resin was obtained. The binder resin 2 had a weight-average molecular weight (Mw) of 70,000, a number average molecular weight (Mn) of 3,100, and a peak molecular weight (Mp) of 5,000.

Binder Resin Production Example 3

42.1 parts by mass of propylene glycol, 56.8 parts by mass of terephthalic acid, 1.1 parts by mass of trimellitic anhydride, and 0.6 part by mass of titanium tetrabutoxide were loaded into a 4-l four-necked flask made of glass. The four-necked flask was equipped with a temperature gauge, a stirring rod, a condenser, and a nitrogen-introducing pipe, and was placed in a mantle heater. Next, the air in the four-necked flask was replaced with a nitrogen gas. Then, the temperature in the flask was gradually increased to 210° C. while the mixture in the flask was stirred. The mixture was subjected to a reaction for 3 hours, whereby a polyester resin 3-1 was obtained. The polyester resin 3-1 had a weight-average molecular weight (Mw) of 5,500, a number average molecular weight (Mn) of 2,000, and a peak molecular weight (Mp) of 3,600.

In addition, 31.4 parts by mass of propylene glycol, 48.0 parts by mass of terephthalic acid, 4.2 parts by mass of trimellitic anhydride, and 0.4 part by mass of titanium tetrabutoxide were loaded into a 4-l four-necked flask made of glass. The four-necked flask was equipped with a temperature gauge, a stirring rod, a condenser, and a nitrogen-introducing pipe, and was placed in a mantle heater. Next, the air in the four-necked flask was replaced with a nitrogen gas, and then the temperature in the flask was gradually increased to 180° C. while the mixture in the flask was stirred. The mixture was subjected to a reaction for 3 hours, and thereafter, 16.4 parts by mass of trimellitic anhydride were added to the flask and the temperature in the flask was increased to 220° C. Then, the mixture was subjected to a reaction for 12 hours, whereby a resin 3-2 having a polyester unit was obtained. The resin 3-2 having a polyester unit had a weight-average molecular weight (Mw) of 100,000, a number average molecular weight (Mn) of 5,000, and a peak molecular weight (Mp) of 9,200.

60 parts by mass of the above polyester resin 3-1 and 40 parts by mass of the polyester resin 3-2 were preliminarily mixed with a Henschel mixer (manufactured by Mitsui Miike Machinery Co., Ltd.), and were then melted and blended with a melting kneader PCM30 (manufactured by Ikegai, Ltd.) at a number of revolutions of 3.3 $s^{-1}$ and a resin-kneading temperature of 100° C., whereby a binder resin 3 was obtained.

Binder Resin Production Example 4

78.0 parts by mass of styrene, 18.5 parts by mass of n-butyl acrylate, 3.5 parts by mass of methacrylic acid, and 0.8 part by mass of 2,2-bis(4,4-di-t-butylperoxycyclohexyl)propane were prepared. While 200 parts by mass of xylene were stirred in a four-necked flask, the air in the container was sufficiently replaced with nitrogen, and the temperature in the container was increased to 120° C. After that, the above respective components were dropped to the flask over 4 hours. Further, polymerization was completed under xylene reflux, and the solvent was removed by distillation under reduced pressure. A resin thus obtained was defined as a vinyl resin 4-1. The molecular weights of the vinyl resin 4-1 by GPC were as follows: a weight-average molecular weight (Mw) of 600,000, a number average molecular weight (Mn) of 200,000, and a peak molecular weight (Mp) of 200,000.

30 parts by mass of the vinyl resin 4-1, 55.0 parts by mass of styrene, 12.0 parts by mass of n-butyl acrylate, 3.0 parts by mass of methacrylic acid, and 1.4 parts by mass of di-t-butyl peroxide were dropped to 200 parts by mass of xylene over 4 hours. Further, polymerization was completed under xylene reflux, and the solvent was removed by distillation under reduced pressure, whereby a binder resin 4 was obtained. The binder resin 4 had a weight-average molecular weight (Mw) of 100,000, a number average molecular weight (Mn) of 5,000, and a peak molecular weight (Mp) of 10,000.

Toner Production Example 1

| | |
|---|---|
| Low-density polyethylene (Mw 1,400, Mn 850, highest endothermic peak by DSC at 100° C.) | 20 parts by mass |
| Styrene | 64 parts by mass |
| n-butyl acrylate | 13.5 parts by mass |
| Acrylonitrile | 2.5 parts by mass |

The above materials were loaded into an autoclave, and the air in the system was replaced with $N_2$. After that, the temperature in the system was increased and held at 180° C. while the mixture was stirred. 50 parts by mass of a 2-mass % solution of t-butyl hydroperoxide in xylene were continuously dropped to the system for 5 hours, and the resultant mixture was cooled. After that, the solvent was removed by separation, whereby a polymer A in which vinyl resin components reacted with the above low-density polyethylene was obtained. The molecular weights of the polymer A were measured, and the following results were obtained: the polymer A had a weight-average molecular weight (Mw) of 7,000 and a number average molecular weight (Mn) of 3,000.

| | |
|---|---|
| Binder resin 1 | 100 parts by mass |
| Polymer A | 2 parts by mass |
| Fischer-Tropsch wax (peak temperature of the highest endothermic peak 105° C.) | 4 parts by mass |
| Magnetic iron oxide (number-average particle diameter 0.20 μm, intensity of magnetization in a magnetic field of 1,000/4π (kA/m) 70 $Am^2/kg$) | 95 parts by mass |
| Monoazo iron compound (1) (the counter ion is $NH_4^+$) | 2 parts by mass |

The above formulations were mixed with a Henschel mixer (FM-75 model, manufactured by Mitsui Miike Machinery Co., Ltd.), and then the mixture was kneaded with a biaxial kneader (PCM-30 model, manufactured by Ikegai, Ltd.) having a temperature set to 130° C. The resultant kneaded product was cooled, and was coarsely pulverized into products each having a size of 1 mm or less with a hammer mill, whereby coarsely pulverized products were obtained. The resultant coarsely pulverized products were pulverized with a mechanical type pulverizer (T-250, manufactured by Turbo Kogyo Co., Ltd.). Further, the resultant pulverized products were classified with a multi-division classifier utilizing Coanda effect, whereby magnetic substance-containing resin particles were obtained. The resultant magnetic substance-containing resin particles had the following characteristics: the particles had a weight-average particle diameter (D4) of 6.3 μm, toner particles each having a particle diameter of 4.0 μm or less accounted for 25.6 number % of the particles, and particles each having a particle diameter of 10.1 μm or more accounted for 2.6 vol % of the particles.

The magnetic substance-containing resin particles were subjected to a surface treatment with the surface smoothing apparatus shown in FIG. 1.

The bottom edge of the airflow-injecting member 102 was provided below the bottom edge of the toner-feeding port 100 at a distance of 100 mm from the bottom edge.

Operating conditions were as follows: a feeding amount of 5 kg/hr, a hot air temperature C of 250° C., a hot air flow rate of 6 $m^3$/min, a cold air temperature E of 5° C., a cold air flow rate of 4 $m^3$/min, a cold air absolute moisture content of 3 g/$m^3$, a blower flow rate of 20 $m^3$/min, an injection air flow rate of 1 $m^3$/min, and a diffusion air of 0.3 $m^3$/min.

The surface treatment under the above conditions resulted in toner particles 1 having the following characteristics: the particles had a weight-average particle diameter (D4) of 6.7 μm, particles each having a particle diameter of 4.0 μm or less accounted for 18.6 number % of the particles, and particles each having a particle diameter of 10.1 μm or more accounted for 3.1 vol % of the particles. The wax in the toner particles 1 had an average primary dispersed particle diameter of 0.25 μm.

The average surface roughness (Ra) and ten point height of roughness (Rz) of the surfaces of the resultant toner particles 1 measured with a scanning probe microscope were 15 nm and 500 nm, respectively.

1.2 parts by mass of hydrophobic silica fine particles having an average primary particle diameter of 16 nm with their surfaces treated with 20 mass % of hexamethyldisilazane were added to 100 parts by mass of the resultant toner particles 1, and the particles were mixed with a Henschel mixer (FM-75 model, manufactured by Mitsui Miike Machinery Co., Ltd.), whereby Toner 1 was obtained.

The resultant toner had an average circularity of 0.970, a surface tension index of $6.3\times10^{-3}$ N/m, and an abundance of the wax on its surface of 85%. Table 1 shows the physical properties of Toner 1 thus obtained.

Toner Production Example 2

Toner 2 was produced in the same manner as in Toner Production Example 1 except that the surface treatment was performed at a hot air temperature of 280° C. Table 1 shows the physical properties of Toner 2 thus obtained.

Toner Production Example 3

Toner 3 was produced in the same manner as in Toner Production Example 1 except that the surface treatment was performed at a hot air temperature of 220° C. Table 1 shows the physical properties of Toner 3 thus obtained.

Toner Production Example 4

Toner particles were produced in the same manner as in Toner Production Example 1 except that: the usage of the Fischer-Tropsch wax (peak temperature of the highest endothermic peak 105° C.) was changed to 10 parts by mass; and the surface treatment was performed at a hot air temperature of 300° C. 1.2 parts by mass of hydrophobic silica fine particles having an average primary particle diameter of 16 nm with their surfaces treated with 10 mass % of dimethyl silicone oil were added to 100 parts by mass of the resultant toner particles, and the particles were mixed with a Henschel mixer (FM-75 model, manufactured by Mitsui Miike Machinery Co., Ltd.), whereby Toner 4 was obtained. Table 1 shows the physical properties of Toner 4 thus obtained.

Toner Production Example 5

| | |
|---|---|
| Binder resin 1 | 100 parts by mass |
| Polymer A | 2.5 parts by mass |
| Paraffin wax (peak temperature of the highest endothermic peak 78° C.) | 5 parts by mass |
| Aluminum compound of 3,5-di-t-butylsalicylic acid | 1.0 part by mass |
| C.I. Pigment Blue 15:3 | 5 parts by mass |

The above formulations were mixed with a Henschel mixer (FM-75 model, manufactured by Mitsui Miike Machinery Co., Ltd.), and then the mixture was kneaded with a biaxial extruder (PCM-30 model, manufactured by Ikegai, Ltd.) having a temperature set to 100° C. The resultant kneaded product was cooled, and was coarsely pulverized into products each having a size of 1 mm or less with a hammer mill, whereby coarsely pulverized products were obtained. The resultant coarsely pulverized products were pulverized with a mechanical type pulverizer (T-250, manufactured by Turbo Kogyo Co., Ltd.). Further, the resultant pulverized products were classified with a multi-division classifier utilizing Coanda effect, whereby toner particles were obtained. The resultant toner particles had the following characteristics: the particles had a weight-average particle diameter (D4) of 5.8 μm, toner particles each having a particle diameter of 4.0 μm or less accounted for 25.6 number % of the particles, and toner particles each having a particle diameter of 10.1 μm or more accounted for 0.2 vol % of the particles.

The toner particles were subjected to a surface treatment with the surface treatment apparatus shown in FIG. 1.

The bottom edge of the airflow-injecting member 102 was provided below the bottom edge of the toner-feeding port 100 at a distance of 100 mm from the bottom edge.

Operating conditions were as follows: a feeding amount of 5 kg/hr, a hot air temperature C of 200° C., a hot air flow rate of 6 $m^3$/min, a cold air temperature E of 5° C., a cold air flow rate of 4 $m^3$/min, a cold air absolute moisture content of 3 g/$m^3$, a blower flow rate of 20 $m^3$/min, an injection air flow rate of 1 $m^3$/min, and a diffusion air of 0.3 $m^3$/min.

The surface treatment under the above conditions resulted in toner particles having the following characteristics: the particles had a weight-average particle diameter (D4) of 6.2 μm, particles each having a particle diameter of 4.0 μm or less accounted for 20.3 number % of the particles, and particles each having a particle diameter of 10.1 μm or more accounted for 2.3 vol % of the particles. The wax in the toner particles had an average primary dispersed particle diameter of 0.10 μm.

The average surface roughness (Ra) and ten point height of roughness (Rz) of the surfaces of the resultant toner particles measured with a scanning probe microscope were 8 nm and 120 nm, respectively.

1.0 part by mass of titanium oxide fine particles having an average primary particle diameter of 50 nm with their surfaces treated with 15 mass % of isobutyltrimethoxysilane and 0.8 part by mass of hydrophobic silica fine particles having an average primary particle diameter of 16 nm with their surfaces treated with 20 mass % of hexamethyldisilazane were added to 100 parts by mass of the resultant toner particles, and the particles were mixed with a Henschel mixer (FM-75 model, manufactured by Mitsui Miike Machinery Co., Ltd.), whereby Toner 5 was obtained.

The resultant toner 5 had an average circularity of 0.970, a surface tension index of $1.3\times10^{-2}$ N/m, and an abundance of the wax on its surface of 90%. Table 1 shows the physical properties of Toner 5 thus obtained.

Toner Production Example 6

Toner 6 was produced in the same manner as in Toner Production Example 5 except that the surface treatment was performed at a hot air temperature of 180° C. Table 1 shows the physical properties of Toner 6 thus obtained.

Toner Production Example 7

Toner 7 was produced in the same manner as in Toner Production Example 5 except that: the binder resin 1 was changed to a binder resin 2; the polymer A was not used; and the surface treatment was performed at a hot air temperature of 220° C. Table 1 shows the physical properties of Toner 7 thus obtained.

Toner Production Example 8

Toner 8 was produced in the same manner as in Toner Production Example 5 except that the binder resin 1 was changed to the binder resin 3. Table 1 shows the physical properties of Toner 8 thus obtained.

Toner Production Example 9

Toner 9 was produced in the same manner as in Toner Production Example 1 except that: the usage of the Fischer-Tropsch wax (peak temperature of the highest endothermic peak 105° C.) was changed to 15 parts by mass; and the surface treatment was performed at a hot air temperature of 250° C. Table 1 shows the physical properties of Toner 9 thus obtained.

Toner Production Example 10

Toner 10 was produced in the same manner as in Toner Production Example 1 except that a surface treatment was performed with a mechanical impact by using a HYBRIDIZER (manufactured by NARA MACHINERY CO., LTD.) instead of the surface treatment apparatus shown in FIG. 1. Table 1 shows the physical properties of Toner 10 thus obtained.

Toner Production Example 11

Toner 11 was produced in the same manner as in Toner Production Example 1 except that the binder resin 1 was changed to the binder resin 4. Table 1 shows the physical properties of Toner 11 thus obtained.

Toner Production Example 12

Toner 12 was produced in the same manner as in Toner Production Example 5 except that the surface treatment with the surface treatment apparatus shown in FIG. 1 was not performed. Table 1 shows the physical properties of Toner 12 thus obtained.

Toner Production Example 13

Toner 13 was produced in the same manner as in Toner Production Example 5 except that: the usage of the paraffin wax (peak temperature of the highest endothermic peak 78° C.) was changed to 15 parts by mass; and the polymer A was not used. Table 1 shows the physical properties of Toner 13 thus obtained.

Toner Production Example 14

450 parts by mass of a 0.12-mol/l aqueous solution of $Na_3PO_4$ were charged into 710 parts by mass of ion-exchanged water, and the mixture was heated to 60° C. The resultant aqueous solution was stirred with a TK-homomixer (manufactured by Tokushu Kika Kogyo) at 250 $s^{-1}$. 68 parts by mass of a 1.2-mol/l aqueous solution of $CaCl_2$ were gradually added to the aqueous solution, whereby an aqueous medium containing $Ca_3(PO_4)_2$ was obtained.

Next, the following materials were heated to 60° C., and were then uniformly dissolved or dispersed with a TK-homomixer (manufactured by Tokushu Kika Kogyo) at 166.7 $s^{-1}$.

| | |
|---|---|
| C.I. Pigment Blue 15:3 | 10 parts by mass |
| Styrene | 160 parts by mass |
| n-butyl acrylate | 30 parts by mass |
| Paraffin wax (peak temperature of the highest endothermic peak 78° C.) | 20 parts by mass |

-continued

| | |
|---|---|
| Aluminum compound of 3,5-di-t-butylsalicylic acid | 0.5 part by mass |
| Saturated polyester (terephthalic acid-propylene oxide-denatured bisphenol A; acid value 15 mgKOH/g, peak molecular weight 6,000) | 10 parts by mass |

Then, 10 parts by mass of a polymerization initiator 2,2'-azobis(2,4-dimethylvaleronitrile) were dissolved in the resultant, whereby a polymerizable monomer composition was prepared.

The resultant polymerizable monomer composition was loaded into the above-mentioned aqueous medium. The resultant mixture was stirred under a nitrogen atmosphere with a TK-homomixer at 60° C. and 200 $s^{-1}$ for 10 minutes so that the polymerizable monomer composition might be granulated. After that, the temperature of the resultant was increased to 80° C. while the resultant was stirred with a paddle stirring blade. Then, the resultant was subjected to a reaction for 10 hours. After the completion of the polymerization reaction, the remaining monomers were removed by distillation under reduced pressure. After the remainder had been cooled, hydrochloric acid was added to dissolve $Ca_3(PO_4)_2$. The resultant dispersion liquid was filtrated, and the product taken by filtration was washed with water and dried, whereby toner particles were obtained. The toner particles had a weight-average particle diameter (D4) of 6.7 μm and an average circularity of 0.970.

1.0 part by mass of titanium oxide fine particles having an average primary particle diameter of 40 nm with their surfaces treated with 12 mass % of isobutyltrimethoxysilane and 0.5 part by mass of hydrophobic silica fine particles having an average primary particle diameter of 20 nm with their surfaces treated with 15 mass % of hexamethyldisilazane were added to 100 parts by mass of the resultant toner particles, and the particles were mixed with a Henschel mixer (FM-75 model, manufactured by Mitsui Miike Machinery Co., Ltd.), whereby Toner 14 was obtained. Table 1 shows the physical properties of Toner 14 thus obtained.

Toner Production Example 15

560 parts by mass of polyoxypropylene (2.2)-2,2-bis(4-hydroxyphenyl)propane, 250 parts by mass of polyoxyethylene (2.2)-2,2-bis(4-hydroxyphenyl)propane, 300 parts by mass of terephthalic acid, and 2 parts by mass of titanium tetrabutoxide were loaded into a 4-1 four-necked flask made of glass. The four-necked flask was equipped with a temperature gauge, a stirring rod, a condenser, and a nitrogen-introducing pipe, and was placed in a mantle heater. The mixture in the flask was subjected to a reaction under a nitrogen atmosphere at 230° C. for 7 hours. After that, the mixture was cooled to 160° C., 30 parts by mass of phthalic anhydride were added to the mixture, and the whole was subjected to a reaction for 2 hours.

Next, the resultant solution was cooled to 80° C. A solution (heated to 80° C. in advance) prepared by dissolving 180 parts by mass of isophorone diisocyanate in 1,000 parts by mass of ethyl acetate was charged into the above solution, and the mixture was subjected to a reaction for 2 hours.

Further, the resultant was cooled to 50° C., 70 parts by mass of isophorone diamine were added to the resultant, and the mixture was subjected to a reaction for 2 hours, whereby a urea-denatured polyester resin was obtained. The urea-denatured polyester resin had a weight-average molecular weight of 60,000, a number average molecular weight of 5,500, and a peak molecular weight of 7,000.

| | |
|---|---|
| Urea-denatured polyester resin described above | 100 parts by mass |
| Ester wax (peak temperature of the highest endothermic peak 72° C.) | 10 parts by mass |
| Aluminum compound of 3,5-di-t-butylsalicylic acid | 1 part by mass |
| C.I. Pigment Blue 15:3 | 6 parts by mass |

The above materials were added to 100 parts by mass of ethyl acetate. The contents were heated to 60° C., and were then uniformly dissolved and dispersed with a TK-homomixer (manufactured by Tokushu Kika Kogyo) at 200 $s^{-1}$.

Meanwhile, 450 parts by mass of a 0.12-mol/l aqueous solution of $Na_3PO_4$ were charged into 710 parts by mass of ion-exchanged water, and the mixture was heated to 60° C. After that, the mixture was stirred with a TK-homomixer (manufactured by Tokushu Kika Kogyo) at 15,000 rpm. 68 parts by mass of a 1.2-mol/l aqueous solution of $CaCl_2$ were gradually added to the resultant aqueous solution, whereby an aqueous medium containing $Ca_3(PO_4)_2$ was prepared.

The above-mentioned dispersion liquid was charged into the resultant aqueous medium, and the resultant mixed liquid was granulated by stirring with a TK-homomixer at 60° C. and 250 $s^{-1}$ for 10 minutes. After that, the temperature of the resultant was increased to 98° C. so that the solvent might be removed while the resultant was stirred with a paddle stirring blade. After the remainder had been cooled, hydrochloric acid was added to dissolve $Ca_3(PO_4)_2$. The resultant mixed liquid was filtrated, and the product taken by filtration was washed with water and dried, whereby particles were obtained. The resultant particles were subjected to air classification, whereby toner particles were obtained. The toner particles had a weight-average particle diameter (D4) of 6.2 μm and an average circularity of 0.975.

1.0 part by mass of titanium oxide fine particles having an average primary particle diameter of 50 nm with their surfaces treated with 15 mass % of isobutyltrimethoxysilane and 0.7 part by mass of hydrophobic silica fine particles having an average primary particle diameter of 16 nm with their surfaces treated with 20 mass % of hexamethyldisilazane were added to 100 parts by mass of the resultant toner particles, and the particles were mixed with a Henschel mixer (FM-75 model, manufactured by Mitsui Miike Machinery Co., Ltd.), whereby Toner 15 was obtained. Table 1 shows the physical properties of Toner 15 thus obtained.

Toner Production Example 16

Toner 16 was produced in the same manner as in Toner Production Example 5 except that the paraffin wax (peak temperature of the highest endothermic peak 78° C.) was not used. Table 1 shows the physical properties of Toner 16 thus obtained.

Toner Production Example 17

Toner 17 was produced in the same manner as in Toner Production Example 5 except that the paraffin wax (peak temperature of the highest endothermic peak 78° C.) was changed to 1 part by mass of a polyethylene wax (peak temperature of the highest endothermic peak 140° C.). Table 1 shows the physical properties of Toner 17 thus obtained.

Toner Production Example 18

| <Dispersion liquid A> | |
|---|---|
| Styrene | 350 parts by mass |
| n-butyl acrylate | 100 parts by mass |
| Acrylic acid | 25 parts by mass |
| t-dodecyl mercaptan | 10 parts by mass |

The above compositions were mixed and dissolved, whereby a monomer mixture was prepared.

| | |
|---|---|
| Dispersion liquid of paraffin wax (peak temperature of the highest endothermic peak 78° C.) (Solid content concentration 30%, dispersed particle diameter 0.14 μm) | 100 parts by mass |
| Anionic surfactant (manufactured by Dai-ichi Kogyo Seiyaku Co., Ltd.: Neogen SC) | 1.2 parts by mass |
| Nonionic surfactant (manufactured by Sanyo Chemical Industries, Ltd.: NONIPOL 400) | 0.5 part by mass |
| Ion-exchanged water | 1,530 parts by mass |

The above formulations were dispersed in a flask, and then heating was initiated while the air surrounding the formulations was replaced with nitrogen. When the temperature of the liquid reached 70° C., a solution prepared by dissolving 6.56 parts by mass of potassium persulfate in 350 parts by mass of ion-exchanged water was charged into the liquid. While the temperature of the resultant liquid was kept at 70° C., the monomer mixture was loaded into the liquid, and the whole was stirred. The temperature of the resultant liquid was increased to 80° C., and then emulsion polymerization was continued for 6 hours without any change. After that, the temperature of the liquid was decreased to 40° C., and then the liquid was filtrated with a filter, whereby a dispersion liquid A was obtained. Particles in the dispersion liquid thus obtained had the following characteristics: the number-average particle diameter of the particles was 0.16 μm, and the solid content of the particles had a glass transition point of 60° C., a weight-average molecular weight (Mw) of 15,000, and a peak molecular weight of 12,000. The content of the paraffin wax in the resultant polymer was 6 mass %.

| <Dispersion liquid B> | |
|---|---|
| C.I. Pigment Blue 15:3 | 12 parts by mass |
| Anionic surfactant (manufactured by Dai-ichi Kogyo Seiyaku Co., Ltd.: Neogen SC) | 2 parts by mass |
| Ion-exchanged water | 86 parts by mass |

The above formulations were mixed, and were then dispersed with a bead mill (ULTRA APEX MILL manufactured by KOTOBUKI INDUSTRIES CO., LTD.), whereby a colorant dispersion liquid B was obtained.

300 parts by mass of the dispersion liquid A and 25 parts by mass of the dispersion liquid B were charged into a 1-1 separable flask mounted with a stirring apparatus, a cooling pipe, and a temperature gauge, and were then stirred. 180 parts by mass of a 10-mass % aqueous solution of sodium chloride as an agglomerating agent were dropped to the mixed liquid, and the mixture in the flask was heated to 54° C. in an oil bath for heating while being stirred. After having been held at 48° C. for 1 hour, the resultant was observed with an optical microscope. As a result, the formation of agglomerated particles each having a particle diameter of about 5 μm was observed.

In a subsequent melt adhesion step, 3 parts by mass of an anionic surfactant (manufactured by Dai-ichi Kogyo Seiyaku Co., Ltd.: Neogen SC) were added to the resultant. After that, a flask made of stainless steel containing the mixture was hermetically sealed. While being continuously stirred with a magnetic seal, the mixture was heated to 100° C., and was held at the temperature for 3 hours. Then, the mixture was cooled. After that, the reaction product was filtrated and sufficiently washed with ion-exchanged water. After that, the washed product was dried, whereby toner particles were obtained. An attempt was made to determine the average primary dispersed particle diameter of the wax in the toner particles by observing the toner particles with a transmission electron microscope (TEM), but no wax domains could be observed. The toner particles had a weight-average particle diameter (D4) of 5.5 μm and an average circularity of 0.960.

1.0 part by mass of titanium oxide fine particles having an average primary particle diameter of 40 nm with their surfaces treated with 10 mass % of isobutyltrimethoxysilane, 0.5 part by mass of hydrophobic silica fine particles having an average primary particle diameter of 20 nm with their surfaces treated with 10 mass % of hexamethyldisilazane, and 1.5 parts by mass of hydrophobic silica fine particles having an average primary particle diameter of 110 nm with their surfaces treated with 10 mass % of hexamethyldisilazane were added to 100 parts by mass of the resultant toner particles, and the particles were mixed with a Henschel mixer (FM-75 model, manufactured by Mitsui Miike Machinery Co., Ltd.), whereby Toner 18 was obtained. Table 1 shows the physical properties of Toner 18 thus obtained.

Magnetic Carrier Production Example 1

4.0 mass % of a silane-based coupling agent (3-(2-aminoethylaminopropyl)trimethoxysilane) were added to a magnetite powder having a number-average particle diameter of 0.28 μm (and an intensity of magnetization in a magnetic field of 10,000/4π (kA/m) of 75 $Am^2/kg$), and the respective fine particles were mixed and stirred at a high speed in a container at 100° C. or higher so as to be treated.

| | |
|---|---|
| Phenol | 10 parts by mass |
| Formaldehyde solution (Formaldehyde 40 mass %, methanol 10 mass %, water 50 mass %) | 6 parts by mass |
| Treated magnetite described above | 84 parts by mass |

The above materials, 5 parts by mass of 28% ammonia water, and 20 parts by mass of water were loaded into a flask, and the temperature of the contents was increased to 85° C. within 30 minutes, and the contents were held at the temperature while the contents were stirred and mixed. The mixture was subjected to a polymerization reaction for 3 hours, and the produced phenol resin was cured. After that, the cured phenol resin was cooled to 30° C., and, furthermore, water was added to the resin. After that, the supernatant was removed, and the precipitate was washed with water, and was then air-dried. Next, the resultant was dried under reduced pressure ($6.7\times10^2$ Pa or less) at a temperature of 60° C., whereby a spherical, magnetic substance-containing resin carrier core in a state where the magnetic substance was dispersed in the phenol resin was obtained.

A carrier coat solution containing 10 mass % of a copolymer of methyl methacrylate and styrene (copolymerization ratio (mass % ratio) 80:20, weight-average molecular weight 45,000) was prepared by using the copolymer of methyl methacrylate and styrene as a coat material, and a mixed solvent of methyl ethyl ketone and toluene as a solvent. In addition, 0.5 part by mass of a melamine resin (having a number-average particle diameter of 0.2 μm) and 1.0 part by mass of carbon black (having a number-average particle diameter of 30 nm and a DBP oil absorption of 50 ml/100 g) with respect to 100 parts by mass of the copolymer were added to the carrier coat solution, and the contents were mixed well with a homogenizer. Next, the magnetic substance-containing resin carrier core was loaded into the mixed solution, and the solvent was volatilized at 70° C. while a shear stress was continuously applied to the mixture. Thus, the surface of the magnetic substance-containing resin carrier core was coated with the copolymer of methyl methacrylate and styrene so that the amount of the copolymer might be 1 part by mass with respect to 100 parts by mass of the magnetic substance-containing resin carrier core.

The resin-coated, magnetic substance-containing resin core coated with the copolymer of methyl methacrylate and styrene was treated with heat by being stirred at 100° C. for 2 hours. After that, the resultant was cooled and shredded, and classified with a 200-mesh sieve (having an aperture of 75 μm), whereby a magnetic carrier 1 having a number-average particle diameter of 35 μm, a true density of 3.73 g/cm$^3$, an intensity of magnetization of 55 Am$^2$/kg, and a contact angle relative to water of 88° was obtained.

Magnetic Carrier Production Example 2

A magnetic carrier 2 was obtained in the same manner as in Magnetic Carrier Production Example 1 except that a copolymer of a monomer using Compound Example 1 shown below as a unit and methyl methacrylate (copolymerization ratio (on a mass basis) 40:60, weight-average molecular weight 45,000) was used as a coat material. The magnetic carrier had a contact angle relative to water of 120°.

[Chem 6]

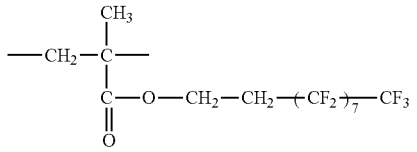

Compound Example 1

Magnetic Carrier Production Example 3

A magnetic carrier 3 was obtained in the same manner as in Magnetic Carrier Production Example 1 except that a copolymer of a monomer using Compound Example 1 shown above as a unit and methyl methacrylate (copolymerization ratio (on a mass basis) 20:80, weight-average molecular weight 45,000) was used as a coat material. The magnetic carrier had a contact angle relative to water of 110°.

Magnetic Carrier Production Example 4

A magnetic carrier 4 was obtained in the same manner as in Magnetic Carrier Production Example 1 except that a copolymer of a monomer using Compound Example 1 shown above as a unit and methyl methacrylate (copolymerization ratio (on a mass basis) 60:40, weight-average molecular weight 45,000) was used as a coat material. The magnetic carrier had a contact angle relative to water of 128°.

Magnetic Carrier Production Example 5

A magnetic carrier 5 was produced in the same manner as in Magnetic Carrier Production Example 1 except that no coat material was used. The magnetic carrier had a contact angle relative to water of 75°.

Example 1

Toner 1 was evaluated by using a laser beam printer Laser Jet4350n manufactured by Hewlett-Packard Company (apparatus for performing magnetic, one-component development) reconstructed to have a process speed of 392 mm/sec (sixty-two A4 lateral sheets/min). Evaluation items and evaluation criteria are shown below. In addition, Tables 2-1 and 2-2 show the results of the evaluation.

(1) Image Density and Fogging

An image output test was performed on a total of 18,000 sheets of plain paper for a copying machine (A4 size: 75 g/m$^2$) within 2 days at a ratio of 9,000 sheets/day as follows: printing was performed on 2 sheets (at a print percentage of 5%) every 10 seconds under each of a normal-temperature, normal-humidity environment (23° C., 60% RH) and a high-temperature, high-humidity environment (32.5° C., 80% RH). The image density and fogging of each of an initial stage (first sheet) and an 18,000-th sheet were measured. An image density measured was a density measured relative to a printed-out image at a white portion having an original density of 0.00 with a "Macbeth reflection densitometer" (manufactured by Macbeth Co.). A difference between the image density of the initial stage (first sheet) and the image density of the 18,000-th sheet was determined, and evaluation was performed on the basis of the following criteria.

A: Less than 0.05
B: 0.05 or more and less than 0.10
C: 0.10 or more and less than 0.20
D: 0.20 or more Meanwhile, the reflectance of the white portion of a fixed image and the reflectance of an unused transfer material were measured. Then, a fogging density was calculated from the following equation, and evaluation for image fogging was performed on the basis of the fogging density. A reflectometer (REFLECTOMETER MODEL TC-6DS manufactured by Tokyo Denshoku Co., Ltd.) was used in the reflectance measurement.

Fogging (%)=reflectance (%) of unused paper−reflectance (%) of image white portion A: Less than 0.5%
B: 0.5% or more and less than 1.0%
C: 1.0% or more and less than 2.0%
D: 2.0% or more (2) Scattering A 5,000-sheet image output test was performed as follows: an image having a print percentage of 4% was output on plain paper for a copying machine (A4 size: 75 g/m$^2$) under each of a normal-temperature, normal-humidity environment (23° C., 60% RH) and a high-temperature, high-humidity environment (32.5° C., 80% RH). A lattice pattern (at an interval of 1 cm) composed of 100-μm (latent image) lines was printed out on each of an initial stage (first sheet) and a 5,000-th sheet, and evaluation for scattering in the printed-out image was performed by visual observation with an optical microscope.

A: Each line is extremely sharp, and nearly no scattering is observed.

B: Slight scattering is observed, but each line is relatively sharp.

C: Scattering is somewhat remarkable, and each line is blurry.

D: Below the level C (3) Toner Consumption

An image having a print percentage of 4% was output on each of 5,000 sheets of plain paper for a copying machine (A4 size: 75 g/m$^2$) under a normal-temperature, normal-humidity environment (23° C., 60% RH). The amount of the toner in a toner container reduced by the output was measured, and a toner consumption per sheet was calculated.

Examples 2 to 4 and Comparative Examples 1 to 3

An image output test was performed in the same manner as in Example 1 except that the toner used was changed to any one of Toners 2 to 4 (corresponding to Examples 2 to 4) and 9 to 11 (corresponding to Comparative Examples 1 to 3), and evaluation was performed in the same manner as in Example 1. Tables 2-1 and 2-2 show the results of the evaluation.

Example 5

10 parts by mass of Toner 5 described above and 90 parts by mass of the magnetic carrier 1 were mixed with a V-type mixer, whereby a two-component developer 1 was prepared.

The above two-component developer 1 was subjected to duration image output evaluation (A4 lateral, 10% print percentage, 50,000 sheets) under each of a normal-temperature, normal-humidity environment (23° C., 60% RH) and a high-temperature, high-humidity environment (32.5° C., 80% RH) by using a reconstructed apparatus of a full-color copying machine iRC6870 manufactured by Canon Inc. (apparatus for performing two-component development) reconstructed so that a process condition might be variable. Image output evaluation items and evaluation criteria at the initial stage of a durability test (first sheet) and after the passing of the 50,000 sheets are shown below. In addition, Tables 3-1 and 3-2 show the results of the evaluation.

(4) Image Density and Fogging at Initial Stage of a Durability Test (First Sheet) and after Passing of 50,000 Sheets A developing voltage was initially adjusted so that the toner laid-on level of an image might be 0.6 mg/cm$^2$. An image density and fogging were measured by using an X-Rite color reflection densitometer (500 series: manufactured by X-Rite). A difference between the image density of the initial stage of a durability test (first sheet) and the image density of the 50,000-th sheet was determined, and evaluation was performed on the basis of the following criteria.

A: Less than 0.05

B: 0.05 or more and less than 0.10

C: 0.10 or more and less than 0.20

D: 0.20 or more

Meanwhile, an average reflectance Dr (%) of plain paper before the image output was measured with a reflectometer (REFLECTOMETER MODEL TC-6DS manufactured by Tokyo Denshoku CO., LTD.).

A solid white image (Vback: 150 V) was output on plain paper at each of the initial stage of a durability test and a time point after the passing of the 50,000 sheets. A reflectance Ds (%) of the output solid white image was measured. Fogging (%) was calculated from the resultant Dr and Ds (at each of the initial stage of a durability test (first sheet) and the time point after the passing of the 50,000 sheets) by using the following equation. The resultant fogging was evaluated in accordance with the following evaluation criteria.

$$\text{Fogging}\ (\%) = Dr(\%) - Ds(\%)$$

(evaluation criteria)

A: Less than 0.5%

B: 0.5% or more and less than 1.0%

C: 1.0% or more and less than 2.0%

D: 2.0% or more (5) Scattering

A lattice pattern (at an interval of 1 cm) composed of 100-μm (latent image) lines was printed out on each of an initial stage (first sheet) and a 50,000-th sheet, and evaluation for scattering in the printed-out image was performed by visual observation with an optical microscope.

A: Each line is extremely sharp, and nearly no scattering is observed.

B: Slight scattering is observed, but each line is relatively sharp.

C: Scattering is somewhat remarkable, and each line is blurry.

D: Below the level C (6) Transferring Performance (Transfer Residual Density)

A developing voltage was initially adjusted so that the toner laid-on level of an image might be 0.6 mg/cm$^2$. A solid image was output at each of the initial stage of a durability test (first sheet) and a time point after the passing of 50,000 sheets. Transfer residual toner on a photosensitive drum at the time of the formation of the solid image was peeled by taping with a transparent adhesive tape made of polyester. A density difference obtained by subtracting the density of paper onto which only an adhesive tape had been stuck from the density of paper onto which the adhesive tape used for the peeling had been stuck was calculated. Then, evaluation for transferring performance was performed with a value for the density difference on the basis of the following criteria. It should be noted that each density was measured with the above-mentioned X-Rite color reflection densitometer (500 series: manufactured by X-Rite).

A: Less than 0.05

B: 0.05 or more and less than 0.10

C: 0.10 or more and less than 0.20

D: 0.20 or more (7) Dot Reproducibility (at Initial Stage of Durability Test (First Page) and after 50,000 Sheets)

A dot image was formed with one pixel being one dot. A one-dot image was formed while the spot diameter of a laser beam from the reconstructed apparatus was adjusted so that the area of one dot on the sheet became 20,000 μm$^2$ or more and 25,000 μm$^2$ or less. The areas of 1,000 dots were measured with a digital microscope VHX-500 (mounted with a lens wide-range zoom lens VH-Z100, manufactured by KEYENCE CORPORATION).

The number average (S) and standard deviation (σ) of the dot areas were calculated, and a dot reproducibility index was calculated from the following equation.

$$\text{Dot reproducibility index} = (\sigma/S) \times 100$$

A: Dot reproducibility index is less than 4.0.

B: Dot reproducibility index is 4.0 or more and less than 6.0.

C: Dot reproducibility index is 6.0 or more and less than 8.0.

D: Dot reproducibility index is 8.0 or more.

Examples 6 to 8 and Comparative Examples 4 to 10

Evaluation was performed in the same manner as in Example 5 except that the toner used was changed to any one of Toners 6 to 8 (corresponding to Examples 6 to 8) and 12 to 18 (corresponding to Comparative Examples 4 to 10) obtained in Toner Production Examples 6 to 8 and 12 to 18. Tables 3-1 and 3-2 show the results of the evaluation.

Examples 9 and 10

An image was formed in the same manner as in Example 5 except that the magnetic carrier used was changed to any one of the magnetic carriers 2 and 3 (corresponding to Examples 9 and 10), and evaluation was performed in the same manner as in Example 5. Tables 3-1 and 3-2 show the results of the evaluation.

Examples 11 and 12

Each image was formed in the same manner as in Example 5 except that the magnetic carrier used was changed to any one of the magnetic carriers 4 and 5 (corresponding to Examples 11 and 12), and evaluation was performed in the same manner as in Example 5. Tables 3-1 and 3-2 show the results of the evaluation.

TABLE 1

| No. | Ra of toner particle surfaces (nm) | Rz of toner particle surfaces (nm) | Capillary pressure of toner ($N/m^2$) | Specific surface area of toner ($m^2/g$) | True density of toner ($g/cm^3$) | Surface tension index of toner (N/m) | Average circularity of toner | Weight-average particle diameter (D4) of toner (μm) | Abundance of wax on toner surface (%) | Average primary dispersed particle diameter of wax in toner particles (μm) |
|---|---|---|---|---|---|---|---|---|---|---|
| 1 | 15.3 | 500 | 25 | 2.2 | 1.8 | 6.3E−03 | 0.970 | 6.7 | 85 | 0.25 |
| 2 | 12.1 | 350 | 30 | 2.1 | 1.8 | 7.9E−03 | 0.980 | 6.7 | 95 | 0.25 |
| 3 | 25.2 | 950 | 25 | 2.4 | 1.8 | 5.8E−03 | 0.955 | 6.7 | 65 | 0.25 |
| 4 | 2.3 | 15 | 350 | 2.0 | 1.8 | 9.7E−02 | 0.985 | 6.7 | 95 | 0.35 |
| 5 | 8.4 | 120 | 35 | 2.3 | 1.2 | 1.3E−02 | 0.970 | 6.2 | 90 | 0.10 |
| 6 | 25.4 | 880 | 20 | 2.4 | 1.2 | 6.9E−03 | 0.955 | 6.2 | 85 | 0.10 |
| 7 | 30.0 | 750 | 150 | 2.2 | 1.2 | 5.7E−02 | 0.965 | 6.2 | 95 | 0.60 |
| 8 | 15.6 | 350 | 25 | 2.3 | 1.2 | 9.1E−03 | 0.970 | 6.2 | 90 | 0.25 |
| 9 | 0.8 | 8 | 200 | 1.0 | 1.8 | 1.1E−01 | 0.975 | 6.7 | 98 | 1.20 |
| 10 | 35.1 | 780 | 150 | 1.8 | 1.8 | 4.6E−02 | 0.965 | 6.7 | 55 | 0.25 |
| 11 | 35.2 | 800 | 15 | 2.0 | 1.8 | 4.2E−03 | 0.975 | 6.7 | 40 | 0.20 |
| 12 | 45.0 | 1100 | 10 | 2.2 | 1.2 | 3.8E−03 | 0.945 | 6.2 | 55 | 0.35 |
| 13 | 25.2 | 500 | 400 | 3.1 | 1.2 | 1.1E−01 | 0.970 | 6.2 | 95 | 0.70 |
| 14 | 12.6 | 300 | 4 | 2.3 | 1.2 | 1.4E−03 | 0.970 | 6.7 | 10 | 1.00 |
| 15 | 15.3 | 200 | 5 | 3.7 | 1.2 | 1.1E−03 | 0.975 | 6.2 | 15 | 0.50 |
| 16 | 25.1 | 500 | 6 | 3.0 | 1.2 | 1.7E−03 | 0.975 | 6.2 | 0 | — |
| 17 | 22.3 | 300 | 5 | 1.0 | 1.2 | 4.2E−03 | 0.970 | 8.1 | 65 | 1.10 |
| 18 | 15.1 | 350 | 11.0 | 2.0 | 1.2 | 4.6E−03 | 0.960 | 5.5 | 50 | — |

TABLE 2-1

| Normal-temperature, normal-humidity (23° C./60% RH) | | | | | | | | | |
|---|---|---|---|---|---|---|---|---|---|
| | Image density | | | | Fogging | | Scattering | | Toner consumption/sheet |
| | Initial stage | 18,000 sheets | Δ | | Initial stage | 18,000 sheets | Initial stage | 5,000 sheets | 5,000 sheets |
| Example 1 | 1.49 | 1.48 | 0.01 | A | A(0.2) | A(0.3) | A | A | 38 mg |
| Example 2 | 1.48 | 1.45 | 0.03 | A | A(0.3) | A(0.4) | A | A | 39 mg |
| Example 3 | 1.40 | 1.35 | 0.05 | B | A(0.3) | B(0.6) | A | B | 40 mg |
| Example 4 | 1.38 | 1.30 | 0.08 | B | B(0.6) | C(1.1) | B | C | 40 mg |
| Comparative Example 1 | 1.35 | 1.21 | 0.14 | C | D(2.2) | D(2.6) | C | D | 51 mg |
| Comparative Example 2 | 1.33 | 1.28 | 0.05 | B | B(0.7) | C(1.2) | C | D | 45 mg |
| Comparative Example 3 | 1.35 | 1.25 | 0.10 | C | C(1.6) | D(2.6) | C | D | 41 mg |

TABLE 2-2

| High-temperature, high-humidity (32.5° C./80% RH) | | | | | | | | | |
|---|---|---|---|---|---|---|---|---|---|
| | Image density | | | | Fogging | | Scattering | | Toner consumption/sheet |
| | Initial stage | 18,000 sheets | Δ | | Initial stage | 18,000 sheets | Initial stage | 5,000 sheets | 5,000 sheets |
| Example 1 | 1.45 | 1.40 | 0.05 | B | A(0.3) | A(0.4) | A | B | 35 mg |
| Example 2 | 1.43 | 1.37 | 0.06 | B | A(0.4) | B(0.5) | A | B | 38 mg |
| Example 3 | 1.35 | 1.28 | 0.07 | B | B(0.5) | C(1.1) | B | B | 39 mg |
| Example 4 | 1.32 | 1.22 | 0.10 | B | C(1.2) | C(1.7) | C | C | 39 mg |

TABLE 2-2-continued

| High-temperature, high-humidity (32.5° C./80% RH) | | | | | | | | | |
|---|---|---|---|---|---|---|---|---|---|
| | Image density | | | | Fogging | | Scattering | | Toner consumption/sheet |
| | Initial stage | 18,000 sheets | Δ | | Initial stage | 18,000 sheets | Initial stage | 5,000 sheets | 5,000 sheets |
| Comparative Example 1 | 1.30 | 1.08 | 0.22 | D | D(2.7) | D(3.2) | D | D | 55 mg |
| Comparative Example 2 | 1.28 | 1.17 | 0.11 | C | C(1.2) | D(2.1) | C | D | 50 mg |
| Comparative Example 3 | 1.28 | 1.01 | 0.27 | D | D(2.1) | D(3.8) | D | D | 55 mg |

TABLE 3-1

| Normal-temperature, normal-humidity (23° C./60% RH) | | | | | | | | | | | | |
|---|---|---|---|---|---|---|---|---|---|---|---|---|
| | Image density | | | | Fogging | | Scattering | | Transferring performance | | Dot reproducibility | |
| | Initial stage | 50,000 sheets | Δ | | Initial stage | 50,000 sheets | Initial stage | 50,000 sheets | Initial stage | 50,000 sheets | Initial stage | 50,000 sheets |
| Example 5 | 1.60 | 1.58 | 0.02 | A | A(0.3) | A(0.4) | A | A | A(0.02) | A(0.03) | A(2.3) | A(2.5) |
| Example 6 | 1.58 | 1.50 | 0.08 | B | A(0.4) | B(0.6) | A | B | B(0.06) | B(0.08) | B(4.2) | B(5.8) |
| Example 7 | 1.58 | 1.55 | 0.03 | A | A(0.3) | B(0.7) | A | A | A(0.03) | A(0.04) | A(2.5) | A(2.8) |
| Example 8 | 1.57 | 1.54 | 0.03 | A | B(0.5) | B(0.8) | A | A | A(0.04) | B(0.07) | A(3.1) | B(4.2) |
| Example 9 | 1.60 | 1.53 | 0.07 | B | B(0.5) | B(0.8) | A | A | A(0.02) | A(0.03) | A(2.8) | A(3.5) |
| Example 10 | 1.60 | 1.56 | 0.04 | A | A(0.4) | B(0.6) | A | A | A(0.02) | A(0.03) | A(2.5) | A(3.1) |
| Example 11 | 1.60 | 1.45 | 0.15 | C | B(0.8) | C(1.5) | A | A | A(0.03) | A(0.04) | A(3.2) | A(3.8) |
| Example 12 | 1.50 | 1.35 | 0.15 | C | B(0.5) | C(1.7) | A | B | B(0.07) | C(0.17) | C(6.5) | B(4.3) |
| Comparative Example 4 | 1.55 | 1.50 | 0.05 | B | B(0.5) | C(1.1) | B | C | C(0.12) | C(0.15) | C(6.2) | C(7.1) |
| Comparative Example 5 | 1.54 | 1.49 | 0.05 | B | A(0.4) | B(0.8) | B | C | B(0.07) | C(0.17) | C(6.5) | D(8.3) |
| Comparative Example 6 | 1.50 | 1.45 | 0.05 | B | B(0.7) | C(1.2) | B | C | A(0.03) | A(0.04) | A(2.3) | A(2.5) |
| Comparative Example 7 | 1.45 | 1.38 | 0.07 | B | C(1.0) | C(1.5) | C | C | A(0.04) | B(0.06) | A(2.8) | A(3.9) |
| Comparative Example 8 | 1.50 | 1.40 | 0.10 | C | B(0.7) | C(1.5) | C | D | A(0.02) | C(0.11) | A(2.5) | B(4.5) |
| Comparative Example 9 | 1.35 | 1.18 | 0.17 | C | C(1.2) | C(1.5) | C | C | C(0.15) | C(0.18) | C(6.8) | D(8.4) |
| Comparative Example 10 | 1.55 | 1.48 | 0.07 | B | B(0.9) | C(1.2) | C | C | A(0.04) | B(0.06) | A(2.5) | A(3.2) |

TABLE 3-2

| High-temperature, high-humidity (32.5° C./80% RH) | | | | | | | | | | | | |
|---|---|---|---|---|---|---|---|---|---|---|---|---|
| | Image density | | | | Fogging | | Scattering | | Transferring performance | | Dot reproducibility | |
| | Initial stage | 50,000 sheets | Δ | Evaluation criteria | Initial stage | 50,000 sheets | Initial stage | 50,000 sheets | Initial stage | 50,000 sheets | Initial stage | 50,000 sheets |
| Example 5 | 1.58 | 1.55 | 0.03 | A | A(0.3) | A(0.4) | A | A | A(0.03) | A(0.04) | A(3.1) | A(3.8) |
| Example 6 | 1.55 | 1.44 | 0.11 | C | C(1.3) | C(1.7) | A | C | C(0.11) | C(0.16) | C(6.2) | C(6.8) |
| Example 7 | 1.52 | 1.40 | 0.12 | C | B(0.8) | C(1.5) | A | A | A(0.03) | C(0.15) | A(3.2) | C(6.5) |
| Example 8 | 1.55 | 1.48 | 0.07 | B | A(0.4) | A(0.4) | A | A | B(0.06) | B(0.07) | A(3.3) | A(3.9) |
| Example 9 | 1.58 | 1.49 | 0.09 | B | C(1.2) | C(1.5) | A | A | A(0.03) | A(0.04) | A(3.5) | B(4.5) |
| Example 10 | 1.58 | 1.50 | 0.08 | B | B(0.6) | B(0.8) | A | A | A(0.03) | A(0.04) | A(3.3) | A(3.8) |
| Example 11 | 1.58 | 1.40 | 0.18 | C | C(1.5) | C(1.8) | A | A | A(0.04) | A(0.05) | A(3.8) | B(4.8) |
| Example 12 | 1.45 | 1.10 | 0.35 | C | B(0.8) | C(1.8) | A | C | B(0.09) | C(0.19) | C(7.2) | C(6.0) |
| Comparative Example 4 | 1.43 | 1.18 | 0.25 | D | D(2.2) | D(2.5) | C | C | C(0.15) | D(0.25) | D(8.5) | D(8.8) |
| Comparative Example 5 | 1.50 | 1.38 | 0.12 | C | B(0.7) | C(1.8) | C | D | C(0.15) | D(0.28) | C(6.2) | D(8.5) |
| Comparative Example 6 | 1.45 | 1.30 | 0.15 | C | C(1.5) | C(1.7) | C | D | A(0.04) | B(0.06) | A(3.5) | A(3.8) |
| Comparative Example 7 | 1.40 | 1.30 | 0.10 | C | C(1.8) | D(2.5) | D | D | B(0.05) | B(0.07) | A(3.2) | A(3.5) |
| Comparative Example 8 | 1.42 | 1.28 | 0.14 | C | C(1.5) | D(2.1) | D | D | A(0.03) | C(0.11) | A(3.5) | A(3.9) |

TABLE 3-2-continued

| | High-temperature, high-humidity (32.5° C./80% RH) | | | | | | | | | | | |
|---|---|---|---|---|---|---|---|---|---|---|---|---|
| | Image density | | | | Fogging | | Scattering | | Transferring performance | | Dot reproducibility | |
| | Initial stage | 50,000 sheets | Δ | Evaluation criteria | Initial stage | 50,000 sheets | Initial stage | 50,000 sheets | Initial stage | 50,000 sheets | Initial stage | 50,000 sheets |
| Comparative Example 9 | 1.35 | 1.00 | 0.35 | D | D(2.2) | D(2.5) | D | D | C(0.12) | D(0.22) | C(7.1) | D(8.3) |
| Comparative Example 10 | 1.48 | 1.30 | 0.18 | C | C(1.1) | D(2.1) | D | D | B(0.05) | B(0.07) | A(2.8) | A(3.1) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-335922, filed Dec. 27, 2007, which is hereby incorporated by reference herein in its entirety.

What is claimed is:

1. A method for producing a toner which comprises toner particles each containing at least a binder resin and a wax, and an external additive, comprising:

melt kneading a binder resin, a wax, and a polymer having a structure obtained by reacting a vinyl-based resin component and a hydrocarbon compound;

cooling the molten kneaded product;

pulverizing the cooled product coarsely and pulverizing the coarsely pulverized product with a mechanical type pulverizer;

treating the surface of the resultant fine pulverized product with hot air, and then cooling the surface-treated product with cold air to provide toner particles, wherein a temperature of the hot air is 100° C. or higher and 450° C. or lower, a temperature of the cold air is −50° C. or higher and 10° C. or lower, and the cold air has an absolute moisture content of 5 g/m$^3$ or less; and adding the external additive to the toner particles, wherein the surface of the toner particles have an average surface roughness (Ra) measured with a scanning probe microscope of 2.0 nm or more and 25.0 nm or less;

wherein the toner has a surface tension index I for a 45-vol % aqueous solution of methanol measured by a capillary suction time method and calculated from the following equation (1) of 5.0×10-3 N/m or more and 1.0×10-1 N/m or less:

$$I=P\alpha/(A\times B\times 106) \quad \text{Eq. (1)}$$

where I represents the surface tension index (N/m) of the toner, Pa represents a capillary pressure (N/m2) of the toner for the 45-vol % aqueous solution of methanol, A represents a specific surface area (m2/g) of the toner, and B represents a true density (g/cm3) of the toner.

2. A method for producing a toner according to claim 1, wherein the surface of the toner particles have a ten point height of roughness (Rz) measured with a scanning probe microscope of 10 nm or more and 1,000 nm or less.

3. A method for producing a toner according to claim 1, wherein the abundance of the wax on a surface of the toner is 60% or more and 100% or less.

* * * * *